United States Patent [19]

Kuwashima et al.

[11] Patent Number: 4,965,179

[45] Date of Patent: Oct. 23, 1990

[54] SILVER HALIDE COLOR PHOTOGRAPHIC MATERIAL

[75] Inventors: Shigeru Kuwashima; Akio Mitsui, both of Kanagawa, Japan

[73] Assignee: Fuji Photo Film Co., Ltd., Kanagawa, Japan

[21] Appl. No.: 289,536

[22] Filed: Dec. 27, 1988

Related U.S. Application Data

[63] Continuation of Ser. No. 853,828, Apr. 21, 1986, abandoned.

[30] Foreign Application Priority Data

Apr. 19, 1985 [JP] Japan ..... 60-83668

[51] Int. Cl.[5] ..... G03C 1/46; G03C 7/396

[52] U.S. Cl. ..... 430/504; 430/506; 430/546

[58] Field of Search ..... 430/504, 506, 546

[56] References Cited

U.S. PATENT DOCUMENTS

| | | | |
|---|---|---|---|
| 2,835,579 | 5/1958 | Thirtle et al. | 430/546 |
| 2,945,761 | 7/1960 | Weissberger | 430/467 |
| 3,698,909 | 10/1972 | Lestena et al. | 430/551 X |
| 3,811,890 | 5/1974 | Ohta et al. | 430/508 |
| 4,178,183 | 12/1979 | Ciurca, Jr. et al. | 430/140 X |
| 4,551,422 | 11/1985 | Kimura et al. | 430/551 |
| 4,614,707 | 9/1986 | Fujita et al. | 430/506 X |

FOREIGN PATENT DOCUMENTS

| | | | |
|---|---|---|---|
| 6030463 | 9/1976 | Japan | 430/546 |
| 1075349 | 4/1986 | Japan | 430/546 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A novel silver halide color photographic material is described, comprising a support having thereon at least three silver halide emulsion layer units each having a sensitivity to each of three primary colors of blue, green and red, wherein at least one unit among said silver halide emulsion layer units comprises a layer group containing at least two layers each having a different sensitivity and at least one layer in said layer group, which satisfies the following condition (A) or (B):

(A) in the case where the silver halide emulsion layer unit is a blue-sensitive or green-sensitive unit, the layer is one to take charge of coloration of a substantially highest density range on a characteristic curve; or (B) in the case where the silver halide emulsion layer unit is a red-sensitive unit, the layer is one other than a layer which is in charge of coloration of a substantially highest density range on a characteristic curve, contains at least one compound of the general formula (I):

(I)

wherein $R_1$ is a linear, branched or cyclic alkyl group having 1 to 20 carbon atoms or a linear, branched or cyclic alkoxy group having 1 to 20 carbon atoms, which may optionally be substituted; $R_2$ represents a hydrogen atom, a halogen atom or a substituent as defined in said $R_1$; n is an integer of 1 to 4, and when n is 2 or more, said $R_2$'s may be the same or different substituents; with the proviso that the total carbon number in said $R_1$ and $R_2$ is 50 or less; dispersed in said layer together with a coupler.

The present silver halide color photographic material can form a color image with a high saturation of an improved color reproducibility in a broad range from a low density to a high density.

18 Claims, No Drawings

SILVER HALIDE COLOR PHOTOGRAPHIC MATERIAL

This is a continuation of application Ser. No. 06/853,828, filed Apr. 21, 1986, now abandoned.

FIELD OF THE INVENTION

The present invention relates to silver halide color photographic materials and, in particular, to those having an improved color reproducibility in a broad range from a low density to a high density.

BACKGROUND OF THE INVENTION

A silver halide color photographic material has, in general, silver halide emulsion layers each having a sensitivity to each of three primary colors of blue, green and red, and each emulsion layer colors in yellow, magenta or cyan, individually, to reproduce a color image, by means of a so-called subtractive color process.

Accordingly, a color image to be reproduced is influenced by the wavelength range to which each photographic layer is sensitive (that is, spectral sensitivity distribution), and in addition, said color image largely depends upon the hue of yellow, magenta or cyan to be colored in each layer, or that is, the spectral absorption characteristic of the coloring dye. In general, said characteristic is not sufficient enough to satisfy a theoretical and ideal color photographic system because of various limitations on the materials to be used. Regarding a coloring dye of a coupler which is generally used as a coloring material in a silver halide color photographic material, for example, some have a spectral absorption in wavelength range, or some others have a second absorption maximum in visible wavelength range, and therefore are not always ideal coloring materials to be used as three primary colors in a subtractive color process.

Under the circumstances, color images obtained in conventional silver halide color photographic materials are not considered to be able to sufficiently reproduce all colors of an object, and the saturation and the hue of the formed color images often somewhat differ from those of the corresponding object.

In order to overcome such inconvenience that the color of an image and that of an object differ in the saturation and the hue, various efforts have heretofore been made in this technical field, for example, to improve the spectral sensitivity distribution of a photographic material or to improve the spectral absorption characteristic of a coloring dye.

One means for improving the spectral absorption of a coloring dye to obtain a sharp spectral absorption with less side absorption is to develop a novel coupler constitution. For instance, development of pivaloyl type yellow couplers (as described in U.S. Pat. No. 3,408,194), anilino type magenta couplers (as described in Japanese Patent Application (OPI) Nos. 74027/74 and 111631/74) (the term "OPI" as used herein refers to a "published unexamined Japanese patent application") and pyrazolotriazole type magenta couplers (as described in U.S. Pat. No. 3,725,067) intends to attain said improvement.

Another means is to change the existing state of a coloring dye in a photographic emulsion of a photographic material so as to improve the spectral absorption of said coloring dye.

For instance, the selection of a high boiling, coupler dispersing solvent is one means for changing the existing state of a coloring dye. Also, U.S. Pat. No. 3,676,137 describes the use of a pyrazolone magenta coupler and a phosphate ester of a high boiling solvent so as to shift the absorption of the coloring dye to the side of a short wavelength range whereby any excess absorption of red rays may be reduced. In addition, phenol compounds which are described in U.S. Pat. No. 2,835,579 as having a high boiling point generally have a high polarity. *Journal of the American Chemical Society*, 73, 919 (1951), etc., report that a pyrazolone-azomethine dye and a phenol type compound may form a hydrogen bond whereby the spectral absorption of the pyrazolone-azomethine dye may be shifted to the side of a long wavelength range. Regarding the use of phenol compounds as a high boiling solvent, U.S. Pat. No. 4,178,183 describes a technique for formation of an infrared ray absorption zone to be used as a recording zone for a color cinematograph movie by the use of a cyan coupler and a phenol type high boiling solvent; and Japanese Patent Application (OPI) No. 171953/84, etc., describe that the spectral absorption characteristic of a 2,5-diacylaminophenol type cyan coupler varies according to the used phenol type high boiling solvent. Said techniques result from the utilization of the fact that the spectral absorption of a cyan dye may be shifted to the side of a long wavelength range by the use of a phenol type high boiling solvent.

None of the above described prior art techniques, however, could attain a sufficient improvement of color reproducibility in silver halide color photographic materials, which is aimed at by the present invention.

A so-called interlayer effect has been developed, where color purity is elevated by means of a development effect, as described in Belgian Patent No. 710,344 (corresponding to U.S. Pat. No. 3,536,487) and German Patent No. 2,043,934 (corresponding to U.S. Pat. No. 3,713,828); and a so-called DIR coupler (as described in U.S. Pat. No. 3,227,554) has been developed for the application of said technique to the field of color photography.

In addition, some other various proposals have heretofore been made in this technical field, including a method where any unnecessary absorption effect of a coloring dye is corrected by the use of a colored coupler having a self-masking function (as described in U.S. Pat. No. 2,455,170) or a method where the spectral sensitivity of each light-sensitive layer is sharpened so as to improve the color separation, etc.

However, any of said methods could not also attain a sufficient color reproducibility as yet.

Apart from said prior art methods, another method has been tried, where plural couplers each forming a coloring dye of a different spectral absorption are used in one emulsion layer.

For instance, a method where a small amount of a different kind of an additional coupler is added to a main coupler whereby "color mixture of an image" is forced is described in Japanese Patent Publication No. 391/65, and a method where two or more magenta couplers are co-used thereby to partially improve the insufficiency of the absorption characteristic of a color image obtained from a main coupler is described in Japanese Patent Application (OPI) No. 71333/75 (corresponding to British Patent No. 1,488,855).

However, said methods still are defective in that the color density range of color reproducibility is narrow.

Under the circumstances, another proposal has been made for a method of formation of a color image with a good color reproducibility from a low density to a high density, saying that it is preferred to change the maximum absorption wavelength of three primary color dyes of a subtractive color process in a high density part and in a low density part, on the basis of a color technological theory. (Said proposal is described in *The Color Gamut Obtainable by the Combination of Subtractive Color Dyes* (*Photo. Science and Engineering*), Vol. 15 (5), pp. 399–415 (in 1971).)

Japanese Patent Publication No. 43887/74 (corresponding to U.S. Pat. No. 3,811,890) describes a method for improving a color reproducibility of a color image by utilizing said theory.

In said method, a silver halide color photographic material having three silver halide emulsion layers each having a sensitivity to each of three primary colors of blue, green and red is used and each of said light-sensitive layers contains two or more couplers each having a different coloring maximum absorption wavelength by 5 nm or more and each having a different coupling speed, whereby the color reproducible density range may be broadened.

Said method is, however, practically difficult and defective in that usable couplers are limited in view of the synthesis thereof or of any other various characteristics thereof (such as solubility, color stain) than the coloring characteristic thereof and that the gradation is apt to vary and the hue is apt to slip off due to the difference of the processing technique in the development step since plural couplers each having a different coupling speed are used.

In particular, the reduction of a colored density is remarkably large because of the reduction of the stirring of a processing bath during development, which is an extreme problem in practice.

SUMMARY OF THE INVENTION

One object of the present invention is to provide a silver halide color photographic material capable of forming a color image with a high saturation and an improved color reproducibility in a broad range from a low density to a high density.

Another object of the present invention is to provide a silver halide color photographic material capable of forming a color image with a high saturation and an improved color reproducibility, which is free from a reduction of a colored density, a variation of a gradation or a slipping of a hue due to the difference of a processing condition during development, especially the reduction of the stirring of a processing bath.

Accordingly, the present invention provides, in order to satisfy said objects, a silver halide color photographic material comprising a support having thereon at least three silver halide emulsion layer units each having a sensitivity to each of three primary colors of blue, green and red, wherein at least one unit among said silver halide emulsion layer units comprises a layer group containing at least two layers each having a different sensitivity and at least one layer in said layer group, which satisfies the following condition (A) or (B):

(A) in the case where the silver halide emulsion layer unit is a blue-sensitive or green-sensitive unit, the layer is one to take charge of coloration of a substantially highest density range on a characteristic curve; or (B) in the case where the silver halide emulsion layer unit is a red-sensitive unit, the layer is one other than a layer which is in charge of coloration of a substantially highest density range on a characteristic curve, contains at least one compound of general formula (I):

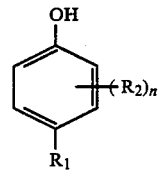

(I)

wherein $R_1$ is a linear, branched or cyclic alkyl group having 1 to 20 carbon atoms or a linear, branched or cyclic alkoxy group having 1 to 20 carbon atoms, which may optionally be substituted; $R_2$ is a hydrogen atom, a halogen atom or a substituent as defined in said $R_1$; n is an integer of 1 to 4, and when n is 2 or more, said $R_2$'s may be the same or different substituents; with the proviso that the total carbon number in said $R_1$ and $R_2$ is 50 or less, dispersed in said layer together with a coupler.

DETAILED DESCRIPTION OF THE INVENTION

Now, the present invention will be explained in detail in the following description.

Color-sensitive silver halide emulsion layer units in the present invention are three color-sensitive silver halide emulsion layer units which are individually sensitive to blue, green and red, respectively, in a three primary color process. At least one unit among them has a layer group containing at least two light-sensitive emulsion layers each having a different sensitivity.

The light-sensitive emulsion layers to be used in the present invention are those containing both a silver halide emulsion having a spectral sensitivity in a determined wavelength range of blue, green or red and an oil dispersion containing a coupler capable of forming a dye which is a complementary color to the color sensitivity of said emulsion.

In the case where the photographic material of the present invention has a light-sensitive emulsion layer group comprising emulsion layers each having a different sensitivity, a gelatin intermediate layer containing a color stain inhibitor or a colloidal silver may be provided between said layers.

The "characteristic curve" as referred to in the present invention is one to express an image density as a function in relation to a logarithmic value of an exposure amount, and the details thereof are described in *The Theory of the Photographic Process* (edited by T. H. James), Vol. 4, pp. 501–509.

In the present invention, the "layer taking charge of coloration of a substantially highest density range on a characteristic curve" means a layer which is in charge of coloration in the part near the maximum density of the characteristic curve.

For instance, said layer corresponds, in general, to the lowest sensitive layer in the case of a photographic material for negative development such as a color print paper or a color positive film; or, in general, to the highest sensitive layer in the case of a photographic material for reversal development such as a color reversal print or a color reversal film.

In said wording, "substantially" means that the density of the layer is 10% or more, preferably 20% or more, of the maximum density value in the characteristic curve of said emulsion layer unit. If the present compound of the general formula (I) is incorporated in a layer which does not satisfy said condition, the object of the present invention for improving the color reproducibility of a formed image cannot sufficiently be attained. Accordingly, it is to be noted that any layer whose density does not satisfy said condition is not considered as the "layer which is in charge of coloration of a substantially highest density range on a characteristic curve" in the present invention.

The compound of the general formula (I) (hereinafter referred to as compound (I)) is incorporated in at least one layer in at least one emulsion unit of the present photographic material in the form of a dispersion together with a coupler, said compound (I)-containing layer satisfying the condition (A) in the case where said unit is blue-sensitive and green-sensitive, or satisfying the condition (B) in the case where said unit is red-sensitive.

A coupler dispersion may be obtained, in general, by dissolving oil-soluble components such as a coupler and a discoloration inhibitor in a high boiling solvent and then dispersing the resulting solution in a gelatin. The compound (I) of the present invention is used together with a coupler, both being dissolved in a high boiling solvent. However, some compounds falling within the scope of the formula (I) may per se have an activity as a high boiling solvent depending upon the number of the carbons in the substituents in the formula (I), and in the case of such compounds a high boiling solvent need not be used other than the compound of the formula (I) itself.

The compounds of the general formula (I) are explained in detail hereunder.

When $R_1$ represents an alkyl group having 1 to 20 carbon atoms, examples thereof are a methyl group, an ethyl group, an n-butyl group, an n-dodecyl group, an n-eicosyl group, an i-propyl group, a t-butyl group, a t-pentyl group, an i-butyl group, a 1,1-dimethylbutyl group, a 1,1,3,3-tetramethylbutyl group, a 2-ethylhexyl group, a cyclopropyl group, a cyclohexyl group, a 4-methylcyclohexyl group, etc.

When R1 represents an alkoxy group having 1 to 20 carbon atoms, examples thereof are a methoxy group, an ethoxy group, an n-butoxy group, an n-dodecyloxy group, an n-eicosyloxy group, an i-propoxy group, a t-butoxy group, a t-pentyloxy group, an i-butoxy group, a 1,1-dimethylbutyloxy group, a 1,1,3,3-tetramethylbutyloxy group, a 2-ethylhexyloxy group, a cyclopropyloxy group, a cyclohexyloxy group, a 4-methylcyclohexyloxy group, etc.

Said alkyl group and alkoxy group may optionally have a substituent (such as a chlorine atom, a hydroxy group, an alkoxycarbonyl group, an acyl group or an acylamino group).

Among the compounds of the formula (I), those of the following general formula (II) are preferred.

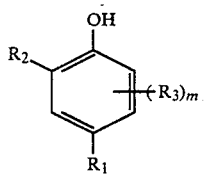

(II)

wherein $R_1$ and $R_2$ have the same meanings as in the formula (I) above; $R_3$ has the same meaning as $R_2$ in the formula (I) above; m is an integer of 1 to 3; when the number of $R_3$ is 2 or more, said $R_3$'s may be the same or different substituents or may be the same as $R_2$.

In the formula (II), $R_2$ is more preferably a hydrogen atom, an alkyl group or a halogen atom (such as a chlorine atom or a bromine atom).

Said substituents $R_1$, $R_2$ and $R_3$ are pertinently selected from the viewpoint of the nondiffusibility of the compounds, the solubility thereof and the effect for shifting the maximum absorption wavelength of the used coloring dye, and the total carbon number in said substituents is to be 50 or less, preferably 32 or less.

Some examples of the compounds of the above described formulae which may be used in the present invention are given below, which, however, do not whatsoever restrict the scope of the present invention.

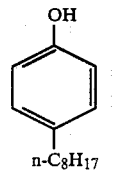

I-1

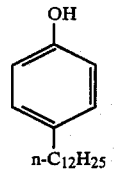

I-2

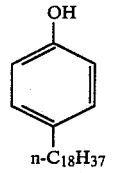

I-3

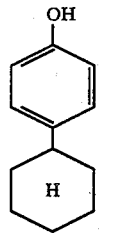

I-4

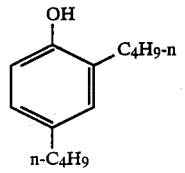

I-5

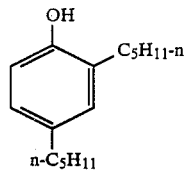

I-6

-continued

I-7

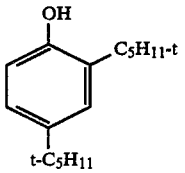

I-8

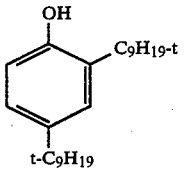

I-9

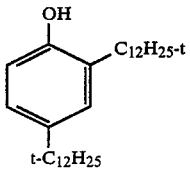

I-10

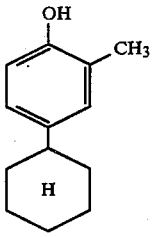

I-11

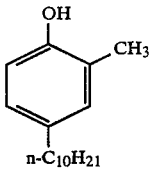

I-12

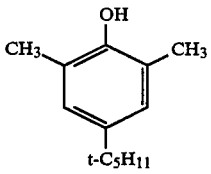

I-13

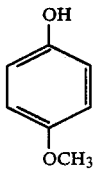

I-14

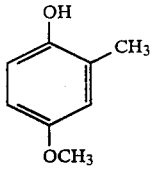

-continued

I-15

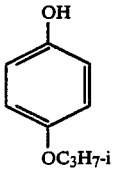

I-16

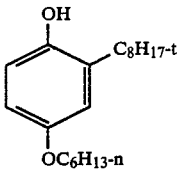

I-17

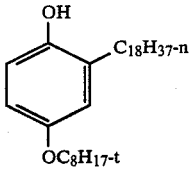

I-18

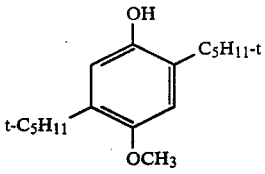

I-19

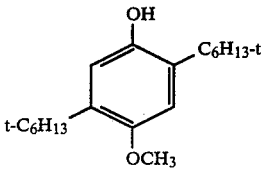

I-20

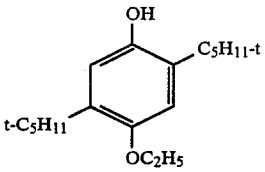

I-21

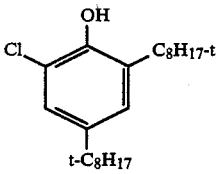

The compounds of the above described formulae to be used in the present invention may be obtained, for example, by a method as described in U.S. Pat. No. 2,835,579 and Japanese Patent Publication No. 27534/77.

The amount of the present compound of said formulae to be added to an emulsion layer varies depending upon the kind of coupler used, the kind of the present compound to be added and, additionally, the kind of a third compound which is dispersed together with the coupler and, in general, said amount is effectively 1 wt % to 5,000 wt %, especially 10 wt % to 500 wt %, on the basis of the weight of coupler used.

The present inventors have found that the incorporation of the compound of the formula (I) in a special layer which may satisfy the above defined condition (A) or (B) results in remarkable and extreme improvement of the color reproducibility of a silver halide color photographic material. In other words, a remarkable improvement of color reproducibility may be attained by the present invention, including a faithful color reproduction of all colors of an object and an enhancement of a firm black density in a formed color image.

Among the silver halide emulsion layer units in a photographic material, a green-sensitive silver halide emulsion layer unit especially strongly affects the color reproductive characteristic of the material since the spectral absorption characteristic of the coloring dye in said unit is similar to a visible sensitivity distribution. Accordingly, the present compound of the formula (I) is especially preferably incorporated in at least one layer, which satisfies the claimed condition, in at least one unit containing a green-sensitive silver halide emulsion layer unit.

According to the present invention, the compound of the formula (I) is incorporated in at least one layer in a layer group constituting a silver halide emulsion layer unit, which satisfies the claimed condition (A) or (B), thereby to improve the color reproducibility of a photographic material, and, moreover, in order to more effectively attain the effect of the present invention, the relation of the coloring maximum absorption wavelength $\lambda_{max}(LD_{max})$ shown by the layer which is in charge of coloration of a substantially highest density on a characteristic curve in said layer group to at least one coloring maximum absorption wavelength $\lambda_{max}(L_x)$ shown by a layer other than said layer preferably satisfies the following condition (C) or (D):

(C) in the case where the silver halide emulsion layer unit is a blue-sensitive or green-sensitive unit:

$$\lambda_{max}(LD_{max})-\lambda_{max}(L_x)\geqq 5 \text{ nm}$$

(D) in the case where the silver halide emulsion layer unit is a red-sensitive unit:

$$\lambda_{max}(L_x)-\lambda_{max}(LD_{max})\geqq 5 \text{ nm}$$

In said condition (C) or (D), the "coloring maximum absorption wavelength" means a light-wavelength capable of attaining a maximum density value of an absorption spectrum of a dye formed in a photographic material by the coupling reaction of a coupler contained in said material with an oxidation product of a phenylenediamine type color developing agent in a color developer solution. Said wavelength, therefore, varies depending upon the kind of coupler contained. In addition, even if the coupler used is the same, said wavelength variously changes depending upon the kind or the amount of the developing agent used and a high boiling solvent to be used for dispersion of the coupler in an emulsion layer as well as the kind or the amount of various kinds of compounds to be contained in said high boiling solvent together with the coupler.

The coloring maximum absorption wavelength in the above described condition (C) or (D) is a value obtained by measurement in a practical film system, and, in practice, said value may be obtained as follow: A single layer is coated on a support, and the film formed is developed in the same developer as that to be used in the development of the present photographic material, and the coloring absorption of the thus developed film sample is measured.

In the case where two or more layers exist on the characteristic curve, which satisfy the condition (A) or (B), all of said layers preferably contain the compound of the formula (I). In addition, the compound of the formula (I) may optionally be incorporated in every layer other than the layers which satisfy the condition (A) or (B); with the proviso that a substantial difference in the spectral absorption of coloring dyes is indispensable between the layers which satisfy the condition (A) or (B) and any other layers, which may be attained, for example, by varying the amount of the compound (I) used in each layer and the structure of the compound (I) contained in each layer; and, in particular, the condition (C) or (D) is especially preferably satisfied in each layer.

Regarding the couplers to be used in the photographic material of the present invention, different couplers may be contained in the layer group in each of the silver halide emulsion layer units, but preferably the same coupler is used in each layer in one layer unit from the viewpoint of the manufacturing cost.

The silver halide color photographic materials of the present invention are especially preferably used as those for direct image observation, including, for example, a color reversal film, a color positive film, a color paper and a color reversal paper.

Useful color couplers which may be used in the present invention are cyan, magenta and yellow coloring couplers; and typical examples of these couplers are naphthol or phenol type compounds, pyrazolone or pyrazoloazole type compounds and open chain or heterocyclic ketomethylene compounds. Specific examples of these cyan, magenta and yellow couplers which may be used in the present invention are described in patent specifications as referred to in *Research Disclosure* (hereinafter referred to as "RD"), No. 17643 (December, 1978), Item VII-D, and No. 18717 (November, 1979)

The color coupler to be incorporated in a photographic material is preferably nondiffusible, as having a ballast group or being polymerized. In particular, 2-equivalent color couplers whose coupling active position is substituted by a releasable group are more preferred than 4-equivalent color couplers whose coupling active position has a hydrogen atom, as the amount of silver to be contained in the coated silver halide emulsion layer may be reduced and the higher sensitivity may be attained in the photographic material formed. In addition, other various kinds of couplers may be used in the present invention, including a coupler to form a coloring dye having a controlled smearing, a noncoloring coupler, a DIR coupler capable of releasing a development inhibitor in the coupling reaction or a coupler capable of releasing a development accelerator in the coupling reaction.

As the yellow coupler which may be used in the present invention, one representative example is an oleophilic acylacetamide type coupler Specific examples thereof are described, for example, in U.S. Pat. Nos. 2,407,210, 2,875,057 and 3,265,506. In the present invention, a 2-equivalent yellow coupler is preferably used, and representative examples thereof are oxygen releasing yellow couplers as described in U.S. Pat. Nos. 3,408,194, 3,447,928, 3,933,501 and 4,022,620, and nitrogen releasing yellow couplers as described in Japanese Patent Publication No. 10739/83, U.S. Pat. Nos. 4,401,752 and 4,326,024, RD No. 18053 (April, 1979), British Patent No. 1,425,020, West German Patent Application (OLS) Nos. 2,219,917, 2,261,361, 2,329,587 and 2,433,812. α-Pivaloylacetanilide type couplers are characterized by the high coloring dye fastness thereof, especially high light fastness, and α-benzoylacetanilide type couplers are characterized by the high color density thereof.

As the magenta coupler which may be used in the present invention are mentioned, for example, oleophilic indazolone type or cyanoacetyl type couplers, preferably 5-pyrazolone type couplers and pyrazoloazole type couplers such as pyrazolotriazoles. Among the 5-pyrazolone type couplers, those having a 3-arylamino or 3-acylamino substituent are preferred in view of the hue of the coloring dye and of the color density thereof. Examples of such couplers are described in U.S. Pat. Nos. 2,311,082, 2,343,703, 2,600,788, 2,908,573, 3,062,653, 3,152,896 and 3,936,015. As a releasable group in a 2equivalent 5-pyrazolone type coupler, a nitrogen releasing group as described in U.S. Pat. No. 4,310,619, or an arylthio group as described in U.S. Pat. No. 4,351,897, is especially preferred. 5-Pyrazolone type couplers having a ballast group as described in European Patent No. 73,636 form a coloring dye having a high color density.

As the pyrazoloazole type couplers are mentioned pyrazolobenzimidazoles as described in U.S. Pat. No. 3,369,897, preferably pyrazolo[5,1-c][1,2,4]triazoles as described in U.S. Pat. No. 3,725,067; pyrazolotetrazoles as described in RD 24220 (June, 1984); and pyrazolopyrazoles as described in RD 24230 (June, 1984). In particular, imidazo[1,2-b]pyrazoles as described in European Patent No. 119,741 are preferred, and pyrazolo[1,5-b][1,2,4]triazoles as described in European Patent No. 119,860 are especially preferred, as these are free from yellow-by-absorption of the coloring dye and have good light fastness.

As the cyan coupler which may be used in the present invention are mentioned, for example, oleophilic naphthol type and phenol type couplers. Representative examples thereof are naphthol type couplers as described in U.S. Pat. No. 2,474,293, and preferably oxygen releasing 2-equivalent naphthol type couplers as described in U.S. Pat. Nos. 4,052,212, 4,146,396, 4,228,233 and 4,296,200 Examples of phenol type couplers are described, for example, in U.S. Pat. Nos. 2,369,929, 2,801,171, 2,772,162 and 2,895,826. Cyan couplers which are fast to humidity and temperature are preferably used in the present invention, and representative examples thereof are phenol type cyan couplers having ethyl or a higher alkyl group in the m-position of the phenol nucleus as described in U.S. Pat. No. 3,772,002; 2,5-diacylamino-substituted phenol type couplers as described in U.S. Pat. Nos. 2,772,162, 3,758,308, 4,126,396, 4,334,011 and 4,327,175 and West German Patent Application (OLS) No. 3,329,729 and Japanese Patent Application No. 42671/83 (corresponding to U.S. Pat. No. 4,500,635); and phenol type couplers having a phenylureido substituent at 2-position and acylamino substituent at 5-position as described in U.S. Pat. Nos. 3,466,622, 4,333,999, 4,451,559 and 4,427,767.

The granularity of the emulsion of the present invention may be improved by the use of a coupler capable of forming a coloring dye having a controlled smearing. Regarding such couplers, examples of magenta couplers are described in U.S. Pat. No. 4,366,237 and British Patent No. 2,125,570; and examples of yellow, magenta or cyan couplers are described in European Patent No. 96,570 and West German Patent Application (OLS) No. 3,234,533.

Dye forming couplers and the above described special couplers may be in the form of a dimer or a more polymeric polymers. Typical examples of polymeric dye forming couplers are described in U.S. Pat. Nos. 3,451,820 and 4,080,211. Examples of polymeric magenta couplers are described in British Patent No. 2,102,173 and U.S. Pat. No. 4,367,282.

In the photographic materials of the present invention, two or more kinds of couplers may be co-used in one light-sensitive layer, or alternatively, one kind of a coupler is incorporated in two or more different layers, so as to satisfy the necessary photographic characteristic in the material.

The coupler and the compound of the formula (I) to be used in the present invention may be incorporated in a photographic material in accordance with various known dispersion methods such as a solid dispersion method or an alkali dispersion method. In particular, a latex dispersion method is preferred, and an oil-in-water dispersion method is more preferred, which are representative means. In said oil-in-water dispersion method, the coupler or the compound of the formula (I) is first dissolved in a single solution comprising either an organic solvent having a high boiling point of 175° C. is, a so-called auxiliary solvent) or in a mixture solution comprising the combination of both of said solvents; and then, the resulting solution is finely dispersed in an aqueous medium such as water or a gelatin aqueous solution in the presence of a surfactant. Examples of high boiling organic solvents are described in U.S. Pat. No. 2,322,027, etc. The dispersion may be accompanied by phase inversion. If necessary, the auxiliary solvent used may be removed or reduced by distillation, noodle washing or ultrafiltration and thereafter the dispersion obtained may be coated on a support.

Examples of high boiling organic solvents are phthalates (such as dibutyl phthalate, dicyclohexyl phthalate, di-2-ethylhexyl phthalate, decyl phthalate, etc.), phosphates and phosphonates (such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate, etc ), benzoates (such as 2-ethylhexyl benzoate, dodecyl benzoate, 2-ethylhexyl p-hydroxybenzoate, etc.), amides (such as diethyldodecanamide, N-tetradecylpyrrolidone, etc.), alcohols and phenols (such as isostearyl alcohol, 2,4-di-tert-amylphenol, etc.), aliphatic carboxylates (such as dioctyl azelate, glycerol tributylate, isostearyl lactate, trioctyl citrate, etc ), aniline derivatives (such as N,N-dibutyl- 2-butoxy-5-tert-octylaniline, etc.), hydrocarbons (such as paraffin, dodecylbenzene, diisopropylnaphthalene, etc.), etc. As the auxiliary solvent may be used organic solvents having a boiling point of about 30° C. or higher, preferably 50° to 160° C. or so, and representative examples thereof are ethyl acetate, butyl acetate, ethyl propionate, methyl ethyl ketone, cyclohexanone, 2-ethoxyethyl acetate, dimethylformamide, etc.

The procedure of the latex dispersion method and the effect thereof as well as examples of latexes to be used for immersion in said method are described in U.S. Pat. No. 4,199,363, West German Patent Application (OLS) Nos. 2,541,274 and 2,541,230.

The standard amount of the color coupler to be used in the present invention is within the range of 0.001 to 1 mol per 1 mol of the photographic silver halide used. In particular, the amount of a yellow coupler to be used is preferably 0.01 to 0.5 mol, that of a magenta coupler to be used is preferably 0.003 to 0.3 mol, and that of a cyan coupler to be used is preferably 0.002 to 0.3 mol.

The silver halide emulsion to be used in the present invention may be prepared, in general, by admixing a solution of a water-soluble silver salt (such as silver nitrate) and a solution of a water-soluble halide (such as potassium bromide, sodium chloride, potassium iodide or a mixture thereof) in the presence of a solution of a water-soluble high molecular substance (such as gelatin) Typical examples of silver halides thus obtained are silver chloride and silver bromide, and in addition, composite silver halides such as silver bromochloride, silver bromoiodcchloride and silver bromoiodide. The silver halide particles may comprise different inner phase and outer surface phase, or may comprise a multiphase constitution having a contact structure, or may comprise a wholly uniform phase In addition, said particles may comprise a mixture of said different crystal constitutions Regarding silver bromoiodide particles comprising different phases, for example, said particles may have a nucleus or a single or plural layers which are rich in silver bromide component over the average halide composition in the particles; or alternatively may have a nucleus or a single or plural layers which are rich in silver iodide component over the average halide composition in the particles. Accordingly, the surface layer of the particle may be coated with a layer which is rich in silver bromide component over the average halide composition in the particle, or vice versa with a layer which is rich in silver iodide component. The average particle size of the silver halide particles of the present invention is preferably within a range of 0.1 μm to 4 μm, especially preferably 0.15 μm to 3 μm. The "particle size" herein mentioned is a particle diameter when the particle is spherical or nearly spherical, or is a length of the edge of a particle when the particle is cubic, and the "average particle size" is based on the projected area of the particles. The particle size distribution may be either narrow or broad. A so-called monodispersion silver halide emulsion having a narrow particle size distribution, where 90% or more, preferably 95% or more, of the total particles, said percentage being relative to the weight or to the number of the particles, may fall within the range of the average particle size ±40%, may be used in the present invention. In the photographic material of the present invention, two or more monodispersion silver halide emulsions each having different particle sizes may together be incorporated in one layer or may separately be incorporated in laminated layers in substantially the same color-sensitive emulsion layer unit for the purpose of satisfying the necessary gradation required in the photographic material In addition, two or more polydispersion silver halide emulsions or a mixture of a monodispersion emulsion and a polydispersion emulsion may together be incorporated in one layer or may separately be incorporated in laminated layers.

The shape of the silver halide particles to be used in the present invention may be either a regular crystalline form such as a cubic, octahedral, dodecahedral or tetradecahedral crystal or an irregular crystalline form such as a spherical crystal, or otherwise, may be a composite crystalline form comprising a mixture of said regular and irregular crystalline forms In addition, the present silver halide particles may be tabular ones, and in particular, an emulsion containing tabular particles having an aspect ratio (length/thickness) of 5 or more, especially 8 or more, in an amount of 50% or more of the total projected area of all particles, may be used in the present invention. The emulsion of the present invention may comprise a mixture of various halide particles of said various kinds of crystalline forms. The emulsions of the present invention, as described above, may be either a surface latent image type emulsion capable of forming a latent image mainly on the surface of the silver halide particles contained or an internal latent image type emulsion capable of forming a latent image in the internal part of said particles.

Photographic emulsions which may be used in the present invention may be prepared by known methods, for example, as described in P. Glafkides, *Chimie et Physique Photographique,* published by Paul Montel Co. (1967); G. F. Duffin, *Photographic Emulsion Chemistry,* published by Focal Press (1966); V. L. Zelikman, *Making and Coating Photographic Emulsion,* published by Focal Press (1964), etc. For instance, any of an acid method, a neutral method, an ammonia method, etc., may be used and, in addition, a single jet method, a double jet method or a combination thereof may be used for the reaction of a soluble silver salt and a soluble halide. A so-called reversal mixing method in which silver halide particles are formed in the presence of an excess silver ion may also be used. In addition, a so-called controlled double jet method, which is one type of a double jet method, may also be used, where the pAg value in the liquid to form silver halide particles is kept constant. According to this method, an emulsion containing silver halide particles having a nearly regular crystalline form and a nearly uniform particle size may be obtained.

In the step of formation of silver halide particles or in the step of physical ripening of said particles, a cadmium salt, a zinc salt, a lead salt, a thallium salt, an iridium salt or a complex salt thereof, a rhodium salt or a complex salt thereof, an iron salt or a complex salt thereof, etc., may be co-used.

The silver halide emuslion is, after formation of the particles contained therein, generally subjected to physical ripening, demineralization and chemical ripening, and then coated on a support.

When the physical ripening is carried out in the presence of a known silver halide solvent (for example, ammonia, Rhodankali or thioethers or thione compounds as described in U.S. Pat. No. 3,271,157, Japanese Patent Application (OPI) Nos. 12360/76, 82408/78, 144319/78, 100717/79 and 155828/79), a monodispersion emulsion having a regular crystalline form and a nearly uniform particle size distribution may be obtained. Removal of soluble silver salts from the emulsion before or after the physical ripening may be carried out by means of noodle washing, flocculation sedimentation method or ultrafiltration method.

The silver halide emulsion to be used in the present invention may be chemically sensitized by means of sulfur or selenium sensitization, reduction sensitization or noble metal sensitization or a combination thereof.

For instance, various known methods may be used for the chemical sensitization, including a sulfur sensitization method in which an active gelatin or a sulfur-containing compound capable of reacting with silver (such as a thiosulfate, a thiourea, a mercapto compound, a rhodanine compound) is used; a reduction sensitization method in which a reducing substance (such as a stannous salt, an amine compound, a hydrazine derivative, a formamidine sulfinic acid, a silane compound) is used; and a noble metal sensitization method in which a metal compound (such as a gold complex as well as a Pt, Ir, Pd, Rh, Fe or other group VIII metal complex) is used. Said sensitization method may be used singly or in the form of a combination of plural kinds of methods.

The photographic emulsion to be used in the present invention is spectrally sensitized with a photographic sensitizing dye. Examples of sensitizing dyes which may be used in said spectral sensitization include cyanine dyes, merocyanine dyes, complex cyanine dyes, complex merocyanine dyes, holopolar cyanine dyes, hemicyanine dyes, styryl dyes and hemioxonol dyes. Especially useful dyes among them are cyanine dyes, merocyanine dyes and complex merocyanine dyes. These dyes may contain any and every conventional basic heterocyclic nucleus, which is generally contained in conventional cyanine dyes, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; alicyclic hydrocarbon ring fused nuclei of said nuclei; and aromatic hydrocarbon ring fused nuclei of said nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a naphthoimidazole nucleus, a quinoline nucleus, an imidazo[4,5-b]quinoline nucleus, etc. These nuclei may optionally have substituent(s) on their carbon atom(s).

Merocyanine dyes and complex merocyanine dyes may contain as a ketomethylene structural nucleus a 5- or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus, a thiobarbituric acid nucleus, a 2-thioselenazolidine-2,4-dione nucleus, a pyrazolo[1,5-a]benzimidazole nucleus, a pyrazolo-[5,1-b]quinazolone nucleus, etc.

Said sensitizing dyes may be used singly, or may be used in the form of a combination of two or more of said sensitizing dyes. The combination use of said sensitizing dyes is often utilized for the purpose of supersensitization.

The photographic emulsion cf the present invention may further contain, together with said sensitizing dye, a dye which per se does not have any spectral sensitization activity or a substance which does not substantially absorb any visible rays but has a supersensitization activity. For example, the present emulsion may contain an aminostilbene compound substituted by a nitrogen-containing heterocyclic group (for example, as described in U.S. Pat. Nos. 2,933,390 and 3,635,721), an aromatic organic acid/formaldehyde condensation product (for example, as described in U.S. Pat. No. 3,743,510), a cadmium salt, an azaindene compound, etc. In particular, the combinations as described in U.S. Pat. Nos. 3,615,613, 3,615,641, 3,617,295 and 3,635,721 are especially preferred.

Various kinds of compounds may be incorporated in the photographic emulsions to be used in the present invention for the purpose of prevention of fog or of stabilization of the photographic characteristics of photographic materials during the formation, preservation or photographic processing of said materials. For instance, various kinds of known fog inhibitors or stabilizers may be used therefor, including azoles such as benzothiazolium salts, benzimidazolium salts, imidazoles, benzimidazoles (preferably 5-nitrobenzimidazoles), nitroindazoles, benzotriazoles (preferably 5-methylbenzotriazoles), triazoles, etc.; mercapto compounds such as mercaptothiazoles, mercaptobenzothiazoles, mercaptobenzimidazoles, mercaptobenzoxazoles, mercaptoxadiazoles, mercaptothiadiazoles, mercaptotriazoles, mercaptotetrazoles (especially 1-phenyl-5-mercaptotetrazole), mercaptopyrimidines, mercaptotriazines, etc.; thiocarbonyl compounds such as oxazolinethione; azaindenes such as triazaindenes, tetraazaindenes (especially 4-hydroxy-6-methyl(1,3,3a,7)tetraazaindene), pentaazaindenes; benzenethiosulfonic acids, benzenesulfinic acids, benzenesulfonic acid amides; purines such as adenine, etc.

Specific examples of said fog inhibitors and stabilizers and the use thereof are described in detail, for example, in U.S. Pat. Nos. 3,954,474, 3,982,947, Japanese Patent Publication No. 28660/77, RD No. 17643 (December, 1978), VIA-VIM, E. J. Birr, *Stabilization of Photographic Silver Halide Emulsion,* published by Focal Press (1974), etc.

The photographic materials obtained according to the present invention may contain, as a color fog inhibitor or a color stain inhibitor, a hydroquinone derivative, an aminophenol derivative, an amine compound, a gallic acid derivative, a catechol derivative, an ascorbic acid derivative, a noncoloring coupler, a sulfonamidophenol derivative, etc.

The photographic materials of the present invention may contain various kinds of a discoloration inhibitor. Typical examples of organic discoloration inhibitors are hindered phenols such as hydroquinones, 6-hydroxychromans, 5-hydroxycoumarans, spirochromans, p-alkoxyphenols and bisphenols; gallic acid derivatives, methylenedioxybenzenes, aminophenols, hindered amines; and ether and ester derivatives of said compounds formed by silylation or alkylation of the phenolic hydroxyl group of said compound In addition, metal complexes such as (bissalicylaldoximato)nickel complexes and (bis-N,N-dialkyldithiocarbamato)nickel complexes may also be used as a discoloration inhibitor.

Specific examples of organic discoloration inhibitors are described in the following patent specifications:

Hydroquinones are described in U.S. Pat. Nos. 2,360,290, 2,418,613, 2,700,453, 2,701,197, 2,728,659, 2,732,300, 2,735,765, 3,982,944, 4,430,425, British Pat. No. 1,363,921, U.S. Pat. Nos. 2,710,801, 2,816,028; 6-hydroxychromans, 5-hydroxycoumarans and spirochromans are described in U.S. Pat. Nos. 3,432,300, 3,573,050, 3,574,627, 3,698,909, 3,764,337, Japanese Patent Application (OPI) No. 152225/77; spiroindanes are described in U.S. Pat. No. 4,360,589; p-alkoxyphenols are described in U.S. Pat. No. 2,735,765, British Patent 2,066,975, Japanese Patent Application (OPI) No. 10539/84, Japanese Patent Publication No. 1976/82; hindered phenols are described in U.S. Pat. No. 3,700,455, Japanese Patent Application (OPI) No. 72225/77, U.S. Pat. No. 4,228,235, Japanese Patent Publication No. 6623/77; gallic acid derivatives, methylenedioxybenzenes and aminophenols are described in U.S. Pat. Nos. 3,457,079, 4,332,886, Japanese Patent Publication No. 21144/81; hindered amines are described in U.S. Pat. Nos. 3,336,135, 4,268,593, British Pat. Nos. 1,326,889, 1,354,313, 1,410,846, Japanese Patent Publication No. 1420/76, Japanese Patent Application (OPI) Nos. 114036/83, 53846/84, 78344/84; phenolic hydroxyl esterified or etherified derivatives are described in U.S. Pat. Nos. 4,155,765, 4,174,220, 4,254,216, 4,264,720, Japanese Patent Application (OPI) Nos. 145530/79, 6321/80, 105147/83, 10539/84, Japanese Patent Publication No. 37856/82, U.S. Pat. No. 4,279,990, Japanese Patent Publication No. 3263/78; metal complexes are described in U.S. Pat. Nos. 4,050,938, 4,241,155, British Pat. No. 2,027,731(A), etc.

Compounds having both hindered amine partial structure and hindered phenol partial structure in one molecule as described in U.S. Pat. No. 4,268,593 are especially effective for prevention of deterioration cf yellow color images due to heat, humidity and light For prevention of deterioration of magenta color images, especially deterioration thereof due to light, spiroindanes as described in Japanese Patent Application (OPI) No. 159644/81 and chromans substituted by hydroquinone diether or monoether, as described in Japanese Patent Application (OPI) No. 89835/80, are especially effective. Said compounds may be added to a light-sensitive layer, after co-emulsified with the corresponding color coupler, in an amount of 5 to 100 wt % of said coupler, whereby the effect may be attained For the purpose of prevention of deterioration of cyan color images due to heat and especially light, it is effective to introduce an ultraviolet absorbent into both layers adjacent to a cyan coloring layer.

In the photographic materials of the present invention, an ultraviolet absorbent may be added to a hydrophilic colloid layer. For instance, aryl-substituted benzotriazoles as described in U.S. Pat. Nos. 3,553,794, 4,236,013, Japanese Patent Publication No. 6540/76 and European Patent No. 57,160; butadienes as described in U.S. Pat. Nos. 4,450,229 and 4,195,999; cinnamate esters as described in U.S. Pat. Nos. 3,705,805 and 3,707,375; benzophenones as described in U.S. Pat. No. 3,215,530 and British Patent 1,321,355; UV absorbent residue-containing high molecular compounds as described in U.S. Pat. Nos. 3,761,272 and 4,431,726 may be used therefor. In addition, UV absorbing brightening agents as described in U.S. Pat. Nos. 3,499,762 and 3,700,455 may also be used. Typical examples of ultraviolet absorbents are described, for example, in RD No. 24239 (June, 1984).

The photographic material of the present invention may contain a water-soluble dye in a hydrophilic colloid layer as a filter dye or for the purpose of irradiation prevention or halation prevention or for some other various purposes For instance, oxonol dyes, hemioxonol dyes, styryl dyes, merocyanine dyes, anthraquinone dyes and azo dyes are preferably used therefor, and in addition, cyanine dyes, azomethine dyes, triarylmethane dyes and phthalocyanine dyes are also useful. Moreover, an oil-soluble dye may also be used, for example, this is emulsified in water by an oil-in-water dispersion method and the resulting emulsion is added to a hydrophilic colloid layer.

Gelatin is preferred as a binder or a protective colloid to be used in the emulsion layer or intermediate layer of the photographic material of the present invention, and in addition, other hydrophilic colloids may also be used therefor. For example, the following substances may be used: protein such as gelatin derivatives, graft polymers of gelatin with other high molecular compounds, albumin, casein, etc.; cellulose derivatives such as hydroxyethyl cellulose, carboxymethyl cellulose, cellulose sulfates, etc.; saccharide derivatives such as sodium alginate, starch derivatives, etc ; and other various kinds of synthetic hydrophilic high molecular substances of mono- or copolymers such as polyvinyl alcohol, partially acetalized polyvinyl alcohol, poly-N-vinylpyrrolidone, polyacrylic acid, polymethacrylic acid, polyacrylamide, polyvinylimidazole, polyvinylpyrazole, etc.

As said gelatin substance a conventional lime-processed gelatin as well as an acid-processed gelatin and an enzume-processed gelatin may be used and, in addition, hydrolyzed products of enzyme-decomposed products of gelatin substances may also be used therefor.

The photographic materials of the present invention may contain an inorganic or organic hardener in any hydrophilic colloid layer constituting the light-sensitive layer or backing layer of said material.

The photographic materials of the present invention may further contain one or more surfactants for various purposes such as coating assistance, static charge prevention, improvement of slide property, emulsification and dispersion, blocking prevention and improvement of photographic characteristics (e.g., development acceleration, high contrast enhancement and sensitization).

The photographic materials of the present invention may further contain, in addition to the above described additive, various kinds of stabilizer, stain inhibitor, developing agent or precursor thereof, development accelerator or precursor thereof, lubricant, mordant agent, matting agent, antistatic agent, plasticizer and/or other various kinds of additives which are useful in photographic materials. Typical examples of these additives are described in RD No. 17643 (December, 978) and No. 18716 (November, 1979).

The present invention may be applied to a multilayer and multicolor photographic material having at least two layers each having different spectral sensitivity on a support A multilayer natural color photographic material has, in general, each at least one red-sensitive emulsion layer, green-sensitive emulsion layer and blue-sensitive emulsion layer on a support. The order of these layers to be coated on a support may freely be selected, and a preferred order thereof is to coat the red-sensitive layer, the green-sensitive layer and the blue-sensitive layer in this order from the side of the support or to coat the blue-sensitive layer, the red-sensitive layer and the green-sensitive layer in this order from the side of the support. Each emulsion layer may comprise two or more emulsion layers each having a different sensitivity, or may contain a light-insensitive layer between or among two or more emulsion layers each having the same sensitivity.

The photographic materials of the present invention preferably have, in addition to the above described silver halide emulsion layers, appropriate auxiliary layers such as a protective layer, an intermediate layer, a filter layer, an antihalation layer, a backing layer, etc.

A color developer which may be used in the development process for the photographic materials of the present invention is preferably an alkaline aqueous solution comprising a main component of an aromatic primary amine color developing agent. For the color developing agent, aminophenol type compounds are useful, and in particular, p-phenylenediamine type compounds are preferably used, and typical examples thereof are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and sulfates, hydrochlorides or p-toluenesulfonates thereof. Said diamines are generally more stable in the form of a salt than :n the form of a free state, and, therefore, salts of said diamines are preferably used.

The color developer generally contains a pH buffer such as an alkali metal carbonate, borate or phosphate, or a development inhibitor or an antifogging agent such as a bromide, an iodide, a benzimidazole compound, a benzothiazole compound or a mercapto compound. In addition, a preservative such as a hydroxylamine or a sulfite salt; an organic solvent such as triethanolamine or diethylene glycol; a development promotor such as benzyl alcohol, polyethylene glycol, a quaternary ammonium salt or an amine compound; a dye forming coupler; a competing coupler; a nucleus forming agent such as sodium boronhydride; an auxiliary developing agent such as 1-phenyl-3-pyrazolidone; a tackifier; a chelating agent such as an aminopolycarboxylic acid, an aminopolyphosphonic acid, an alkylphosphonic acid or a phosphonocarboxylic acid; and an antioxidant as described in West German Patent Application (OLS) No. 2,622,950 may optionally be added to the color developer, if necessary.

In a development process of a reversal color photographic material, in general, said material is first subjected to black-and-white development and then subjected to color development. In the black-and-white development process, a conventionally known black-and-white developer such as a dihydroxybenzene compound (e.g., hydroquinone), a 3-pyrazolidone compound (e.g., 1-phenyl-3-pyrazolidone) or an aminophenol compound (such as N-methyl-p-aminophenol) may be used singly or in the form of a mixture of said developer compound.

The photographic emulsion layer is, after being color developed, in general, bleached The bleaching process may be carried out simultaneously with fixing treatment or, alternatively, separately therefrom. As a bleaching agent may be used, for example, iron (III), cobalt (II), chromium (IV), copper (II) or the like polyvalent metal compounds as well as peracids, quinones and nitroso compounds. Typical examples of bleaching agents which may be used in the present invention are ferricyanides; bichromates; iron (II) or cobalt (III) organic acid complexes such as metal complexes with an aminopolycarboxylic acid (e.g., ethylenediaminetetraacetic acid, diethylenetriaminepentaacetic acid, nitrilotriacetic acid, 1,3-diamino-2-propanoltetraacetic acid) or with other organic acid (e.g., citric acid, tartaric acid or malic acid); persulfates; manganates; nitrosophenols, etc. In particular, iron (III) ethylenediaminetetraacetate and persulfates are preferred among them from the viewpoint that rapid processing is pcssible and that the agents used do nor contaminate the environment. In addition, iron (III) ethylenediaminetetraacetate complex is especially useful in both an independent bleaching solution and a combined bleach-fixing solution.

The bleaching solution or the bleach-fixing solution may optionally contain various kinds of promotors; if necessary. For instance, a bromine ion or an iodine ion and a thiourea compound as described in U.S. Pat. No. 3,706,561, Japanese Patent Publication Nos. 8506/70 and 26586/74, and Japanese Patent Application (OPI) Nos. 32735/78, 36233/78 and 37016/78; a thiol compound as described in Japanese Patent Application (OPI) Nos. 124424/78, 95631/78, 57831/78, 32736/78, 65732/78 and 52534/79 and U.S. Pat. No. 3,893,858; a heterocyclic compound as described in Japanese Patent Application (OPI) Nos. 59644/74, 140129/75, 28426/78, 141623/78, 104232/78 and 35727/79; a thioether type compound as described in Japanese Patent Application (OPI) Nos. 20832/77, 25064/80 and 26506/80; a tertiary amine as described in Japanese Patent Application (OPI) No. 84440/73; a thiocarbamoyl compound as described in Japanese Patent Application (OPI) No. 42349/74, etc., may be used singly, or in the form of a mixture of two or more of said compounds. In particular, bromine ion, iodine ion, thiol compounds and disulfide compounds are preferred as a bleaching promotor among them. When a color photographic material for camera is subjected to bleaching-fixation, said bleaching promotors are especially effective.

As a fixing agent may be used a thiosulfate, a thiocyanate, a thioether type compound, a thiourea compound and a large amount of an iodide; and a thiosulfate salt compound is generally used among them. As a preservative for said bleach-fixing solution or fixing solution, a sulfite, a bisulfite or a carbonyl-bisulfite addition compound is preferred.

After the bleaching-fixation process or the fixing process, in general, the photographic material is rinsed with water. During the process of rinsing with water, various kinds of known compounds may be added to the processing system, for the purpose of prevention of sedimentation and of economization of the amount of water to be used. For the purpose of prevention of sedimentation, for example, a water softener such as an inorganic phosphoric acid, an aminopolycarboxylic acid or an organic phosphoric acid; an antibacterial agent or an antifungal agent for prevention of growth of various kinds of bacteria, algae or fungi; a hardener such as a magnesium salt or an aluminum salt; a surfactant for the purpose of prevention of drying charge or unevenness, etc., may be added to a rinsing solution case by case and in accordance with the necessity of said additive As the case may be, a compound as described in L. E. West, *Water Quality Criteria,* published by Phot. Sci. Eng. (1965), Vol. 6, pp. 344–359 may optionally be added. In particular, addition of a chelating agent or an antifungal agent is effective.

The water washing process is generally carried out by means of countercurrent water streams from two or more water tanks for the purpose of economization of the amount of water to be used. Instead of said water washing process, a multistage countercurrent stabilization treatment may be carried out, as described in Japanese Patent Application (OPI) No. 8543/82. In the latter stabilization treatment, countercurrent baths comprising 2 to 9 tanks are required In this stabilization bath may be incorporated various kinds of compounds for the purpose of stabilization of the images formed. For instance, typical examples of such additive compounds are various kinds of buffers capable of controlling the pH value of a coated film (for example, within the range of pH of 3–8), such as borates, metaborates, borax, phosphates, carbonates, potassium hydroxide, sodium hydroxide, aqueous ammonia, monocarboxylic acids, dicarboxylic acids, polycarboxylic acids, which are used in the form of a combination thereof, or formalin. In addition, other various kinds of additives, such as a water softener (e.g., an inorganic phosphoric acid, an aminopolycarboxylic acid, an organic phosphoric acid, an aminopolyphosphonic acid, a phosphonocarboxylic acid), an antibacterial agent (e.g., benzoisothiazolinone, isothiazolone, 4-thiazolinebenzimidazole, a halogenated phenol), a surfactant, a brightening agent and/or a hardener may be used, singly or in the form of a mixture of two or more different kinds of compounds, if necessary.

As ammonium salt, such as ammonium chloride, ammonium nitrate, ammonium sulfate, ammonium phosphate, ammonium sulfite or ammonium thiosulfate, is preferably added to the present photographic material, after the above described treatment, as a pH controlling agent for the coated layer.

The silver halide photographic material of the present invention may contain a color developing agent, as previously incorporated therein, in order that the photographic treatment of said material may be simplified and speeded up. For this, a precursor of a color developing agent is preferably incorporated in the photographic material. For instance, various kinds of precursors may be used, including indoaniline type compounds as described in U.S. Pat. No. 3,342,597; Schiff base type compounds as described in U.S. Pat. No. 3,342,599 and RD Nos. 14850 and 15159; aldol compounds as described in RD No. 13924; metal complexes as described in U.S. Pat. No. 3,719,492; and urethane type compounds as described in Japanese Patent Application (OPI) No. 135628/78; as well as other various kinds of base type precursors as described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82 and 83565/82.

The silver halide color photographic material of the present invention may optionally contain a 1-phenyl-3-pyrazolidone type compound, as previously incorporated therein, for the purpose of acceleration of the color development, if necessary. Typical compounds therefor are described, for example, in Japanese Patent Application (OPI) Nos. 64339/81, 144547/82, 211147/82, 50532/83, 50536/83, 50533/83, 50534/83, 50535/83 and 115438/83.

In the present invention, solutions to be used in various photographic treatments as described above arc used at a temperature of 10° C. to 50° C. In general, a standard temperature for photographic processing is within the range of 33° C. to 38° C. In practice, however, it is possible to elevate the treating temperature sc as to accelerate the treatment or vice versa to lower the treating temperature so as to attain the improvement cf the image quality formed or to enhance the stability of the processing solution used In addition, a treatment by the use of a cobalt intensifier or a hydrogen peroxide intensifier may be carried out, as described, for example, in West German Patent No. 2,226,770 and U.S. Pat. No. 3,674,499 for the purpose of economization of silver to be used in the photographic material.

Now, the present invention will be explained in greater detail by reference to the following examples, which, however, are not intended to be interpreted as limiting the scope of the present invention.

EXAMPLE 1

The following first layer (lowermost layer) to the following third layer (uppermost layer) were coated on a cellulose triacetate film, as described below, to obtain a magenta coloring photographic material (mg/m$^2$ herein means a coated amount). This is Sample A-1.

Third layer: Protective Layer:

| | |
|---|---|
| Gelatin | 1,500 mg/m$^2$ |

Second Layer: Green-Sensitive Layer of High Sensitivity:

| | |
|---|---|
| Silver bromoiodide containing 3.0 mol % of silver iodide | 1,000 mg/m$^2$ |
| Magenta coupler (1-(2,4,6-trichlorophenyl)-3-(2-chloro-5-tetradecanamido)anilino-2-pyrazolin-5-one) | 300 mg/m$^2$ |
| Coupler solvent (trihexyl phosphate) | 1,500 mg/m$^2$ |

First Layer: Green-Sensitive Layer of Low Sensitivity:

| | |
|---|---|
| Silver bromoiodide containing 3.0 mol % of silver iodide | 1,000 mg/m$^2$ |
| Magenta coupler (same as the second layer) | 300 mg/m$^2$ |
| Coupler solvent (Compound I-7 as listed hereinbefore) | 1,500 mg/m$^2$ |

Next, the following first layer and second layer were coated on a cellulose triacetate film, which is Sample A-2. This Sample A-2 is a comparative sample, where a compound as described in Japanese Patent Publication No. 43887/74 (corresponding to U.S. Pat. No. 3,811,890) was used in comparison.

Second Layer: Protective Layer:

| | |
|---|---|
| Gelatin | 1,500 mg/m$^2$ |

First Layer: Green-Sensitive Layer:

A magenta coupler having the following formula (in an amount equimolar to the coupler in the second layer of Sample A-1):

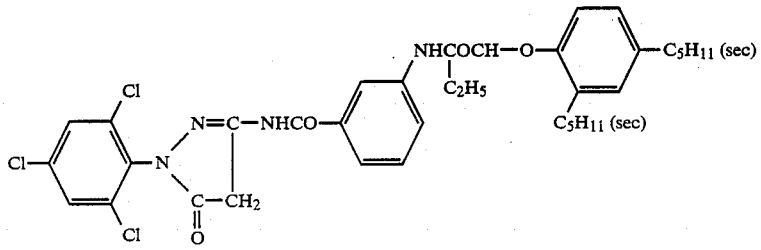

and a magenta coupler having the following formula (in an amount equimolar to the coupler in the first layer of Sample A-1):

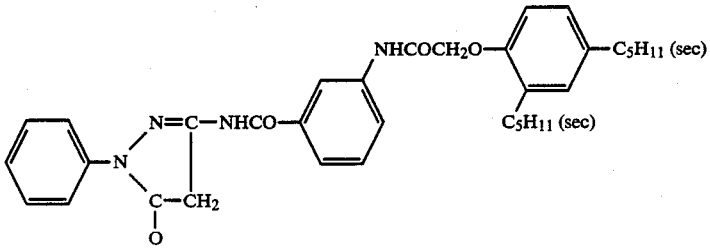

were coated. Other components were the same as those in the first layer and the second layer of Sample A-1, as combined, with the exception that trihexyl phosphate only was used as the coupler solvent.

Next, in the same manner as for Sample A-1 with the exception that the coupler solvent in the first layer was substituted by trihexyl phosphate, which was the same as that in the second layer, Sample A-3 was prepared.

These samples were exposed to light with a light source having a stepwise varying light strength for sensitometry and then developed as follows:

| Process | Temperature (°C.) | Time (min) |
|---|---|---|
| Color Development | 21 | 7 |
| Water Washing | 21 | 1 |
| First Fixing | 21 | 4 |
| Water Washing | 21 | 3 |
| Bleaching | 21 | 3 |
| Water Washing | 21 | 2 |
| Second Fixing | 21 | 3 |
| Water Washing | 18 | 20 |

| Color Developer: | |
|---|---|
| Water | 1,000 ml |
| Benzyl Alcohol | 120 ml |
| Sodium Hexametaphosphate | 2.0 g |
| Sodium Sulfite (anhydride) | 2.0 g |
| Sodium Carbonate (monohydrate) | 27.5 g |
| Hydroxylamine Sulfate | 2.5 g |
| 4-Amino-3-methyl-N-ethyl-N-(β-methanesulfonamido)aniline Sesquisulfate (monohydrate) | 4.0 g |
| **Fixing Solution (pH = 4.5):** | |
| Water | 1,000 ml |
| Sodium Thiosulfate (hexahydrate) | 80 g |
| Sodium Sulfite (anhydride) | 5 g |
| Borax | 6 g |
| Glacial Acetic Acid | 1 ml |
| Potash Alum | 7 g |
| **Bleaching Solution (pH = 7.2):** | |
| Water | 1,000 ml |
| Red Prussiate of Potash | 17 g |
| Boric Acid | 10 g |
| Borax | 5 g |
| Potassium Bromide | 7 g |

After the above treatment, the spectral reflection spectrum of each of Samples A-1, A-2 and A-3 was measured with a spectrophotometer, and the maximum absorption wavelength of magenta was obtained therefrom in each case In the above color development, the stirring of the color developer was suppressed in one group comprising Samples A-1, A-2 and A-3, and the maximum color density of magenta (Dmax) was measured in each case; while the stirring of the color developer was normal in the other group comprising said samples, and the value of Dmax was also measured in each case. Both of the obtained values Dmax in the former and the latter groups were compared with each other, and the decrement (ΔD) of the value Dmax in the former group (where the stirring was suppressed) from that in the latter group (normal stirring) was calculated. The results are given in the following Table 1.

TABLE 1

Maximum Wavelength (nm) of Color and Decrement of Dmax

| Sample No. | Maximum Absorbance of Color 0.5 | 1.0 | 1.5 | 2.0 | Decrement of Dmax (ΔDmax) |
|---|---|---|---|---|---|
| A-1 (Invention) | 535 | 537 | 539 | 540 | 0.05 |
| A-2 (Comparison) | 539 | 540 | 541 | 544 | 0.36 |
| A-3 (Comparison) | 535 | 535 | 535 | 535 | 0.06 |

Maximum Wavelength of Color in Single Layer-Coated Sample (1st layer-coated sample, 2nd layer-coated sample) of Sample A-1

| | 1st Layer-Coated Sample [λmax (LDmax)] | 2nd Layer-Coated Sample [λmax (Lx)] | Difference [λmax (LDmax) − λmax (Lx)] |
|---|---|---|---|
| Maximum Wavelength of Color | 550 nm | 535 nm | 15 nm |

Table 1 proves the following facts: In both of Sample A-1 (invention) and Sample A-2 (comparison), the maximum wavelength shifted to the side of a long wavelength range with the increment of the color density, and, thus, the necessary wavelength shifting could be attained for the enlargement of the color reproducible range of a color film in both samples However, the decrement of ΔDmax (due to the suppression of the stirring of the processing bath) was small in Sample A-1 (invention); whereas the decrement of ΔDmax was large in Sample A-2 (comparison). Thus, it is apparent that the latter comparative sample is not practicable. Regarding the other Comparative Sample A-3, the maximum wavelength did not change even with variation of the degree of the color density and, thus, it is noted that Comparative Sample A-3 is not effective for enlargement of the color reproducible range of a color film.

EXAMPLE 2

The following first layer (lowermost layer) to sixth layer (uppermost layer) were coated on a paper support both surfaces of which were laminated with polyethylene, as described below, to obtain a multilayer color photographic material (mg/m$^2$ herein means a coated amount). This is Sample B-1.

Sixth Layer: Protective Layer:

| | |
|---|---|
| Gelatin | 1,500 mg/m$^2$ |

Fifth Layer; Red-Sensitive Layer:

| | |
|---|---|
| Silver bromochloride emulsion (silver bromide: 50 mol %) | 250 mg (silver)/$m^2$ |
| Gelatin | 1,500 mg/$m^2$ |
| Cyan coupler*1 | 500 mg/$m^2$ |
| Coupler solvent*2 | 250 mg/$m^2$ |

Fourth Layer: Ultraviolet Absorption Layer:

| | |
|---|---|
| Gelatin | 1,200 mg/$m^2$ |
| Ultraviolet absorbent*3 | 700 mg/$m^2$ |
| Ultraviolet absorbent solvent*2 | 250 mg/$m^2$ |

Third Layer:

| | |
|---|---|
| Silver bromochloride emulsion (silver bromide: 70 mol %) | 350 mg (silver)/$m^2$ |
| Gelatin | 1,500 mg/$m^2$ |
| Magenta coupler*4 | 400 mg/$m^2$ |
| Coupler solvent*5 | 400 mg/$m^2$ |

Second Layer: Intermediate Layer:

| | |
|---|---|
| Gelatin | 1,000 mg/$m^2$ |

First Layer: Blue-Sensitive Layer:

| | |
|---|---|
| Silver bromochloride emulsion (silver bromide: 80 mol %) | 350 mg (silver)/$m^2$ |
| Gelatin | 1,500 mg/$m^2$ |
| Yellow coupler*6 | 500 mg/$m^2$ |
| Coupler solvent*2 | 500 mg/$m^2$ |

Support: Polyethylene laminated paper (containing a white pigment (e.g., $TiO_2$) and a bluish dye (e.g., ultramarine) in the polyethylene laminated on the side of the first layer)

*1 Cyan coupler: 2-(2'-Chlorobenzoylamido)-4-chloro-5-[2'-(2''-chloro-4''-tert-amyl)phenoxy]octylamidophenol

*2 Coupler solvent Trinonyl phosphate

*3 Ultraviolet absorbent: 2-(2-Hydroxy-3-sec-butyl-5-t-butylphenyl) benzotriazole

*4 Magenta coupler: 1-(2,4,6-Trichlorophenyl)-3-[2-chloro-5-tetradecanamido]anilino-2-pyrazolin-5-one

*5 Coupler solvent: o-Cresyl phosphate

*6 Yellow coupler: α-Pivaloyl-α-[(2,4-dioxo-5,5'-dimethyloxazolidin-3-yl)-2-chloro-5-(α-2,4-di-t-amyphenoxy) butanamido]acetanilide Next, Sample B-2 was formed as follows: The amount of silver, that of gelatin and that of coupler in the fifth layer of Sample B-1 each were divided into two parts to form two different layers each having a different sensitivity, the silver halide particles in these two different layers each having a different average particle size. To the layer of higher sensitivity in said two layers, 100 mg/$m^2$ of Compound I-9 (as listed hereinbefore) was added. Thus, Sample B-2 was prepared analogously to Sample B-1, the sensitivity and the gradation of Sample B-2 were adjusted to the same as those of Sample B-1.

In the same manner as with Sample B-2, with the exception that Compound I-7 (as listed hereinbefore) was used as the coupler solvent in the layer of higher sensitivity instead of Compound I-9 as used in Sample B-2, another Sample B-3 was formed, having the same sensitivity and the same gradation as those of Sample B-1.

In the same manner as with Sample B-1, with the exception that 40 mol % of the cyan coupler (relative coupling velocity constant 4.0) used in the fifth layer of Sample B-1 was substituted by the following cyan coupler (maximum absorption wavelength: 658 nm, relative coupling velocity constant 0.9), which is described in Japanese Patent Publication No. 43887/74 (corresponding to U.S. Pat. No. 3,811,890), still another Sample B-4 was formed.

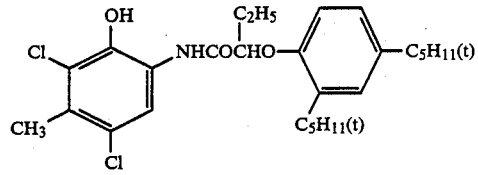

Each of the above formed Samples B-1, B-2, B-3 and B-4 was subjected to red exposure and then processed according to the following treatments:

In the light exposure, the cyan density was measured by the use of a densitometer Fuji FSD-103, and the amount of the light for the exposure was so adjusted that said density was 0.5, 1.0, 1.5 and 2.0.

| Processing Steps (33° C.): | |
|---|---|
| Color Development | 3 min 30 sec |
| Bleach-Fixation | 1 min 30 sec |
| Water Washing | 3 min |
| Drying (50–80° C.) | 2 min |

The solution used in each of the above steps comprises the following components:

| | |
|---|---|
| Color Developer: | |
| Benzyl Alcohol | 12 ml |
| Diethylene Glycol | 5 ml |
| Potassium Carbonate | 25 g |
| Sodium Chloride | 0.1 g |
| Sodium Bromide | 0.5 g |
| Anhydrous Sodium Sulfite | 2 g |
| Hydroxylamine Sulfate | 2 g |
| Brightening Agent | 1 g |
| N-Ethyl-N-β-methanesulfonylamidoethyl-3-methyl-4-aminoaniline Sulfate | 4 g |
| Water to make | 1 liter |
| NaOH to make pH of 10.2 | |
| Bleach-Fixing Solution: | |
| Ammonium Thiosulfate | 124.5 g |
| Sodium Metabisulfite | 13.3 g |
| Anhydrous Sodium Sulfite | 2.7 g |
| EDTA Ferric Ammonium Salt | 65 g |
| Color Developer (as above) | 100 ml |
| Water to make | 1 liter |
| | (pH 6.7–6.8) |

The development was carried out by the use of a conventional roller transport type developing processor, while the developer was constantly and normally supplemented in the processing tank and the composition of the developer used was almost constantly equilibrated.

After the above treatment, the spectral reflection spectrum of each of Samples B-1 through B-4 was measured, and the maximum absorption wavelength of cyan was obtained therefrom in each case.

In the above color development, the stirring of the color developer was suppressed in one group comprising Sample B-1 through B-4, and the maximum color density of cyan (Dmax) was measured in each case; while the stirring of the color developer was normal in the other group comprising said samples, and the value of Dmax was also measured in each case. Both of the obtained values Dmax in the former and the latter groups were compared with each other, and the decrement (ΔD) of the value Dmax in the former group (where the stirring was suppressed) from that in the latter group (normal stirring) was calculated. The results are given in the following Table 2.

TABLE 2

| Sample No. | Maximum Absorption Wavelength (nm) of Color and Decrement of Dmax: Cyan Density (FSD-103) 0.5 | 1.0 | 1.5 | 2.0 | Density Decrement (ΔD) |
|---|---|---|---|---|---|
| B-1 (Comparison) | 658 | 658 | 658 | 658 | 0.05 |
| B-2 (Invention) | 658 | 657 | 656 | 651 | 0.05 |
| B-3 (Invention) | 662 | 662 | 660 | 652 | 0.05 |
| B-4 (Comparison) | 658 | 656 | 652 | 648 | 0.28 |

| | Maximum Wavelength of Color in Single Layer-Coated Sample of Sample B-2 or Sample B-3 (nm): Lower Sensitive Layer [λmax (LDmax)] | Higher Sensitive Layer [λmax (Lx)] | [λmax (Lx) − λmax (LDmax)] |
|---|---|---|---|
| B-2 | 647 | 668 | 21 |
| B-3 | 647 | 670 | 23 |

Table 2 proves the following facts: In the present samples, the maximum absorption wavelength shifted to the side of a short wavelength range with the increment of the color density and, thus, the necessary wavelength shifting could be attained for the enlargement of the color reproducible range of a color film to form a cyan image in the present samples. In addition, an apparent improvement of saturation of the color formed was admitted in the present samples in visual observation. On the other hand, although the Comparative Sample B-4 showed a favorable phenomenon that the maximum absorption wavelength fairly shifted to the side of a short wavelength range with the increment of the color density, the decrement of ΔDmax (due to the suppression of the stirring of the processing bath) was large in Comparative Sample B-4. Thus, it is apparent that Comparative Sample B-4 is not practicable.

EXAMPLE 3

The following first layer (lowermost layer) to third layer (uppermost layer) were coated on a paper support both surfaces of which were laminated with polyethylene, as described below, to obtain color photographic material Samples C-1 through C-12 (mg/m$^2$ herein means a coated amount).

Third layer: Protective Layer:

| | |
|---|---|
| Gelatin | 1,500 mg/m$^2$ |

Second Layer: High Sensitive Layer:

| | |
|---|---|
| Silver bromoiodide emulsion containing 3.5 mol % of silver iodide (average particle size: 0.9 μm) | 200 mg (Ag)/m$^2$ |
| Coupler (given in Table 3) | 150 mg/m$^2$ |
| Oil-soluble component (including coupler solvent but coupler) (the amount given in Table 3) | |

First Layer: Low Sensitive Layer:

| | |
|---|---|
| Silver bromoiodide emulsion containing 3.5 mol % of silver iodide (average particle size: 0.4 μm) | 200 mg (Ag)/m$^2$ |
| Coupler (given in Table 3) | 150 mg/m$^2$ |
| Oil-soluble component (including coupler solvent but coupler) (the amount given in Table 3) | |

The kind and the amount of the coupler and the oil-soluble component used in the above layers are given in the following Table 3.

The formed Samples C-1 through C-12 were uniformly exposed to light and then developed as described below.

In the light exposure, the cyan density, magenta density and yellow density were measured in accordance with the color hue of each sample by the use of a densitometer Fuji FSD-103, and the amount of the light for the exposure was so adjusted that said density was 0.5, 1.0, 1.5 and 2.0, respectively.

| Processing Steps: | | |
|---|---|---|
| First Development (black-and-white development) | 38° C. | 75 sec |
| Water Washing | 38° C. | 90 sec |
| Reversal Exposure | | 100 lux |
| Color Development | 38° C. | 135 sec |
| Water Washing | 38° C. | 45 sec |
| Bleach-Fixing | 38° C. | 120 sec |
| Water Washing | 38° C. | 135 sec |
| Drying | | |

The solution used in each of the above steps comprises the following components:

| | |
|---|---|
| **First Developer:** | |
| Hexasodium Nitrilo-N,N,N-trimethylene-phosphonate | 3.0 g |
| Anhydrous Potassium Sulfite | 20.0 g |
| Sodium Thiocyanate | 1.2 g |
| 1-Phenyl-4-methyl-4-hydroxymethyl-3-pyrazolidone | 2.0 g |
| Anhydrous Sodium Carbonate | 30.0 g |
| Potassium Hydroquinone Monosulfonate | 30.0 g |
| Potassium Bromide | 2.5 g |
| Potassium Iodide (0.1% aq. soln.) | 2 ml |
| Water to make | 1,000 ml |
| | (pH 9.7) |
| **Color Developer:** | |
| Benzyl Alcohol | 15.0 ml |
| Ethylene Glycol | 12.0 ml |
| Hexasodium Nitrilo-N,N,N-trimethylene-phosphonate | 3.0 g |
| Potassium Carbonate | 26.0 g |
| Sodium Sulfite | 2.0 g |
| 1,2-Di(2-hydroxyethyl)mercaptoethane | 0.6 g |
| Hydroxylamine Sulfate | 3.0 g |
| 3-Methyl-4-amino-N-ethyl-N-β-methane-sulfonamidoethylanilinesulfate | 5.0 g |
| Sodium Bromide | 0.5 g |
| Potassium Iodide (0.1% aq. soln.) | 0.5 ml |
| Water to make | 1,000 ml |
| | (pH 10.5) |
| **Bleach-Fixing Solution:** | |
| Iron (III) Ammonium Ethylenediamine-N,N,N',N'-tetraacetate (dihydrate) | 80.0 g |
| Sodium Metabisulfite | 15.0 g |
| Ammonium Thiosulfate (58% aq. soln.) | 126.6 ml |
| 2-Mercapto-1,3,5-triazole | 0.20 g |
| Water to make | 1,000 ml |
| | (pH 6.5) |

After the above treatment, the spectral reflection spectrum of each sample was measured with a spectrophotometer, and the maximum absorption wavelength of color was obtained therefrom in each case. The results are given in the following Table 3.

TABLE 3

| Sample No. | Coupler | Oil-Soluble Component in 1st Layer | Oil-Soluble Component in 2nd Layer | | Density (FSD-103) 0.5 | 1.0 | 1.5 | 2.0 | |
|---|---|---|---|---|---|---|---|---|---|
| C-1 | Coupler-1 | Tricresyl phosphate (75 mg/m$^2$) | Compound I-7 (as listed above) (150 mg/m$^2$) | Yellow | 441 | 441 | 444 | 447 | (Invention) |
| C-2 | Coupler-1 | Tricresyl phosphate (75 mg/m$^2$) | Compound I-8 (as listed above) (37.5 mg/m$^2$) Compound I-19 (as listed above) (37.5 mg/m$^2$) | Yellow | 440 | 441 | 443 | 447 | (Invention) |
| C-3 | Coupler-1 | Tricresyl phosphate (75 mg/m$^2$) | Compound I-2 (as listed above) (75 mg/m$^2$) Tricresyl phosphate (75 mg/m$^2$) | Yellow | 441 | 442 | 444 | 446 | (Invention) |
| C-4 | Coupler-1 | Tricresyl phosphate (75 mg/m$^2$) | Tricresyl phosphate (75 mg/m$^2$) | Yellow | 440 | 440 | 440 | 440 | (Comparison) |
| C-5 | Coupler-2 | Tricresyl phosphate (150 mg/m$^2$) | Compound I-8 (as listed above) (150 mg/m$^2$) | Magenta | 542 | 543 | 545 | 550 | (Invention) |
| C-6 | Coupler-3 | Tricresyl phosphate (150 mg/m$^2$) | Compound I-18 (as listed above) (50 mg/m$^2$) Compound I-8 (as listed above) (50 mg/m$^2$) Tricresyl phosphate (50 mg/m$^2$) | Magenta | 535 | 535 | 537 | 543 | (Invention) |
| C-7 | Coupler-4 | Tricresyl phosphate (150 mg/m$^2$) | Compound I-18 (as listed above) (75 mg/m$^2$) Tricresyl phosphate (75 mg/m$^2$) | Magenta | 540 | 540 | 540 | 548 | (Invention) |
| C-8 | Coupler-2 | Tricresyl phosphate (150 mg/m$^2$) | Tricresyl phosphate (150 mg/m$^2$) | Magenta | 541 | 541 | 541 | 541 | (Comparison) |
| C-9 | Coupler-5 | Compound I-6 (as listed above) (150 mg/m$^2$) | Tricresyl phosphate (150 mg/m$^2$) | Cyan | 668 | 668 | 666 | 659 | (Invention) |
| C-10 | Coupler-5 | Compound I-6 (listed above) (75 mg/m$^2$) Compound I-8 (as listed above) (75 mg/m$^2$) | Tricresyl phosphate (150 mg/m$^2$) | Cyan | 668 | 668 | 666 | 659 | (Invention) |
| C-11 | Coupler-6 | Compound I-6 (as listed above) (75 mg/m$^2$) Compound I-18 (as listed above) (75 mg/m$^2$) | Tricresyl phosphate (150 mg/m$^2$) | Cyan | 660 | 660 | 653 | 650 | (Invention) |
| C-12 | Coupler-5 | Tricresyl phosphate (150 mg/m$^2$) | Tricresyl phosphate (150 mg/m$^2$) | Cyan | 659 | 659 | 659 | 659 | (Comparison) |

Coupler-1

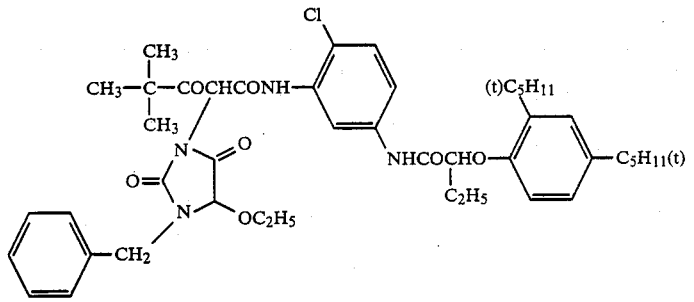

-continued
Coupler-2
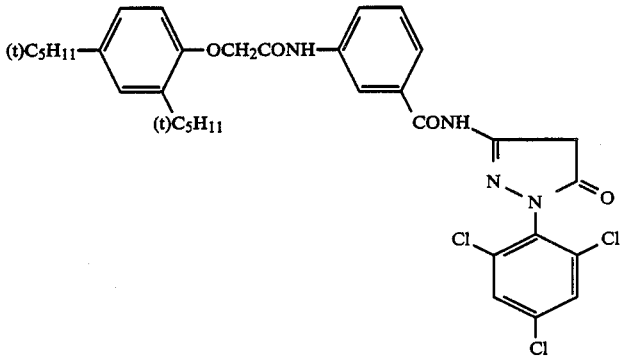
Coupler-3
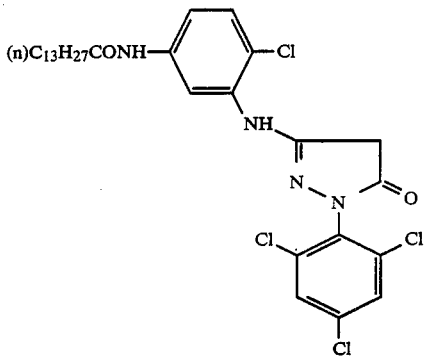
Coupler-4
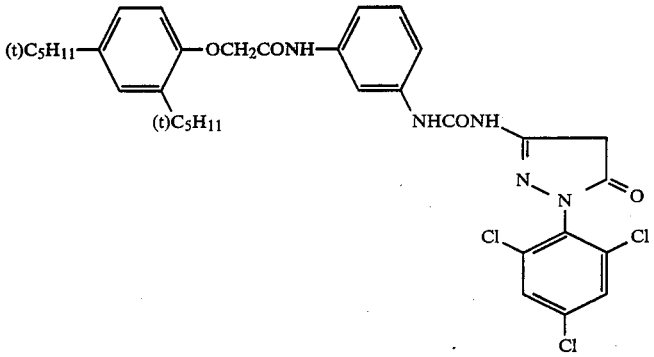
Coupler-5
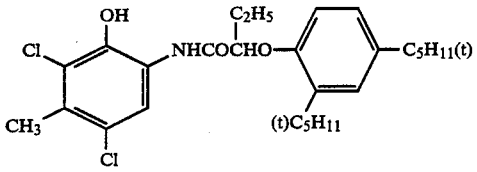
Coupler-6
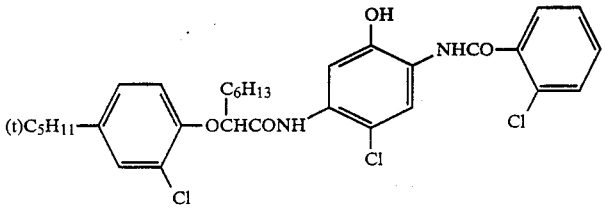
Table 3 proves that the maximum wavelength shifted in accordance with the increment of the color density in the samples of the present invention, and thus, the necessary wavelength shifting could be attained for the enlargement of the color reproducible range of a color film in the present samples.

EXAMPLE 4

The following first layer (lowermost layer) to eleventh layer were coated on a paper support both surfaces of which were laminated with polyethylene, as described below, to obtain a multilayer color photographic material (mg/m$^2$ herein means a coated amount). This is Sample D-1.

Eleventh Layer: Protective Layer:

| | |
|---|---|
| Gelatin | 1,000 mg/m$^2$ |
| Silver bromochloride emulsion (silver bromide: 2.0 mol %, average particle size: 0.2 μm) | 10 mg (silver)/m$^2$ |

Tenth Layer: Ultraviolet Absorption Layer:

| | |
|---|---|
| Gelatin | 1,500 mg/m$^2$ |
| Ultraviolet absorbent*1 | 1,000 mg/m$^2$ |
| Ultraviolet absorbent solvent*2 | 300 mg/m$^2$ |
| Color stain inhibitor*3 | 80 mg/m$^2$ |

Ninth Layer: Blue-Sensitive Layer of High Sensitivity:

| | |
|---|---|
| Silver bromoiodide emulsion spectrally sensitized by blue sensitizing dye*4 (silver iodide: 2.5 mol %, average particle size: 1.0 μm) | 200 mg(silver)/m$^2$ |
| Gelatin | 1,000 mg/m$^2$ |
| Yellow coupler*5 | 400 mg/m$^2$ |
| Coupler solvent*2 | 100 mg/m$^2$ |

Eighth Layer: Blue-Sensitive Layer of Low Sensitivity:

| | |
|---|---|
| Silver bromoiodide emulsion spectrally sensitized by blue sensitizing dye*4 (silver iodide: 2.5 mol %, average particle size: 0.5 μm) | 150 mg(silver)/m$^2$ |
| Gelatin | 500 mg/m$^2$ |
| Yellow coupler*5 | 200 mg/m$^2$ |
| Coupler solvent*2 | 50 mg/m$^2$ |

Seventh Layer: Yellow Filter Layer:

| | |
|---|---|
| Yellow colloidal silver | 200 mg/m$^2$ |
| Gelatin | 1,000 mg/m$^2$ |
| Color stain inhibitor*6 | 60 mg/m$^2$ |
| Color stain inhibitor solvent*7 | 240 mg/m$^2$ |

Sixth Layer: Green-Sensitive Layer of High Sensitivity:

| | |
|---|---|
| Silver bromoiodide emulsion spectrally sensitized by green sensitizing dye*8 (silver iodide: 3.5 mol %, average particle size: 0.9 μm) | 200 mg(silver)/m$^2$ |
| Gelatin | 700 mg/m$^2$ |
| Magenta coupler*9 | 150 mg/m$^2$ |
| Discoloration Inhibitor A*10 | 50 mg/m$^2$ |
| Discoloration Inhibitor B*11 | 50 mg/m$^2$ |
| Discoloration Inhibitor C*12 | 20 mg/m$^2$ |
| Coupler solvent*13 | 150 mg/m$^2$ |

Fifth Layer: Green-Sensitive Layer of Low Sensitivity;

| | |
|---|---|
| Silver bromoiodide emulsion (silver iodide: 2.5 mol %, average grain size: 0.4 μm) | 200 mg(silver)/m$^2$ |
| Green sensitizing dye, gelatin, magenta coupler, discoloration inhibitors, coupler solvent: same as the 6th layer | |

Fourth Layer: Intermediate Layer:

| | |
|---|---|
| Yellow colloidal silver | 20 mg/m$^2$ |
| Gelatin | 1,000 mg/m$^2$ |
| Color stain inhibitor*6 | 80 mg/m$^2$ |
| Color stain inhibitor solvent*7 | 160 mg/m$^2$ |
| Polymer latex*14 | 400 mg/m$^2$ |

Third Layer: Red-Sensitive Layer of High Sensitivity:

| | |
|---|---|
| Silver bromoiodide emulsion spectrally sensitized by red sensitizing dye*15, 16 (silver iodide: 8.0 mol %, average particle size: 0.7 μm) | 100 mg(silver)/m$^2$ |
| Gelatin | 500 mg/m$^2$ |
| Cyan coupler*17 | 100 mg/m$^2$ |
| Discoloration inhibitor*18 | 50 mg/m$^2$ |
| Coupler solvent*19 | 20 mg/m$^2$ |

Second Layer: Red-Sensitive Layer of Low Sensitivity:

| | |
|---|---|
| Silver bromoiodide emulsion spectrally sensitized by red sensitizing dye*15, 16 (silver iodide: 3.5 mol %, average particle size: 0.35 μm) | 150 mg(silver)/m$^2$ |
| Gelatin | 1,000 mg/m$^2$ |
| Cyan coupler*17 | 300 mg/m$^2$ |
| Discoloration inhibitor*18 | 150 mg/m$^2$ |
| Coupler solvent*19 | 60 mg/m$^2$ |

First Layer: Antihalation Layer:

| | |
|---|---|
| Black colloidal silver | 100 mg/m$^2$ |
| Gelatin | 2,000 mg/m$^2$ |

Support: Polyethylene laminated paper (containing a white pigment (e.g., $TiO_2$) and a bluish dye (e.g., ultramarine) in the polyethylene laminated on the side of the first layer)

*1 5-Chloro-2-(2-hydroxy-3-t-butyl-5-t-octyl)phenylbenzotriazole
*2 Trinonyl phosphate
*3 2,5-di-sec-octylhydroquinone
*4 Triethylammonium 3-[2-(3-benzylrhodanin-5-ylidene)-3-benzoxazolinyl]propanesulfonate
*5 α-Pivaloyl-α-[(2,4-dioxo-1-benzyl-5-ethoxyhydantoin-3-yl)-2-chloro-5-(α-2,4-di-t-amylphenoxy)butanamido]-acetanilide
*6 2,5-Di-t-octylhydroquinone
*7 o-Cresyl phosphate
*8 Sodium 5,5-diphenyl-9-ethyl-3,3-disulfopropyloxacarbocyanine
*9 1-(2,4,6-Trichlorophenyl)-3-(2-chloro-5-tetradecanamido) anilino-2-pyrazolin-5-one
*10 3,3',3',3'-Tetramethyl-5,6, 5',6'-tetrapropoxy-1,1'-bisspiroindane
*11 Di(2-hydroxy-3-t-butyl-5-methylphenyl)methane
*12 2,5-Di-t-hexylhydroquinone
*13 Trioctyl phosphate
*14 Polyethyl acrylate
*15 Triethylammonium 3-[2-{2-[3-(3-sulfonatopropyl)-naphtho [1,2-α]thiazolin-2-ylidene-methyl]-1-butenyl}-3-naphtho[1,2-α]thiazolino]-propanesulfonate
*16 Sodium 5,5'-dichloro-3,3'-di(3-sulfobutyl)-9-ethylthiacarbocyanine
*17 2-(2-Chlorophenylamido)-5-[2'(2''-chloro-4''-t-amylphenoxy) butyramido]-4-chlorophenol
*18 2-(2-Hydroxy-3-sec-butyl-5-t-butylphenyl)benzotriazole
*19 Dioctyl phthalate Another Sample D-2 was prepared in the same manner as Sample D-1 with the exception of the following points: The coupler solvent (trioctyl phosphate) in the sixth layer in Sample D-1 was substituted by 75 mg/m$^2$ of Compound I-8 (as listed hereinbefore), and in addition, 75 mg/m$^2$ of Compound I-9 (as listed hereinbefore) was added thereto. A half amount of the coupler solvent (dioctyl phthalate) in the second layer in Sample D-1 was substituted by Compound I-3 (as listed hereinbefore). The sensitivity and the gradation of Sample D-2 were adjusted to the same as those of Sample D-1.

Each of these Samples D-1 and D-2 was subjected to red and green exposure, and then developed in the same manner as described in Example 3.

In the light exposure, the cyan density and the magenta density were measured by the use of a densitometer Fuji FSD-103, and the amount of the light for the exposure was so adjusted that said density was 0.5, 1.0, 1.5 and 2.0, respectively.

After the processing, the spectral reflection spectrum of each sample was measured with a spectrophotometer, and the maximum absorption wavelength of magenta and cyan was obtained therefrom in each case. The results are given in the following Table 4.

TABLE 4

| | Maximum Absorption Wavelength (nm) of Color | | | | | | | |
|---|---|---|---|---|---|---|---|---|
| | Magenta Dyesity (FSD-103) | | | | Cyan Density (FSD-103) | | | |
| Sample No. | 0.5 | 1.0 | 1.5 | 2.0 | 0.5 | 1.0 | 1.5 | 2.0 |
| D-1 (Comparison) | 536 | 536 | 536 | 535 | 648 | 648 | 648 | 648 |
| D-2 (Invention) | 535 | 536 | 539 | 541 | 658 | 655 | 651 | 650 |

| | Single Layer-Coated Sample (5th layer-coated sample, 6th layer-coated sample) of Sample D-2 | | |
|---|---|---|---|
| | 5th Layer-Coated Sample [λmax(Lx)] | 6th Layer-Coated Sample [λmax(LDmax)] | [λmax(LDmax) − λmax(Lx)] |
| Maximum Wave-length of Color | 535 nm | 548 nm | 13 nm |

| | Single Layer-Coated Sample (2nd layer-coated sample, 3rd layer-coated sample) of Sample D-2 | | |
|---|---|---|---|
| | 2nd Layer-Coated Sample [λmax(Lx)] | 3rd Layer-Coated Sample [λmax(LDmax)] | [λmax(Lx) − λmax(LDmax)] |
| Maximum Wave-length of Color | 660 nm | 648 nm | 12 nm |

Table 4 proves that the maximum absorption wavelength of the cyan image shifted to the side of a short wavelength range and that of the magenta image to the side of a long wavelength range with the increment of the color density in the present sample, and thus, the necessary wavelength shifting could be attained for the enlargement of the color reproducible range of a color film to form a color image in the present sample.

In addition, an apparent improvement of saturation of the color image formed was admitted in an actual print using the present sample.

EXAMPLE 5

The following first layer to twelfth layer were coated on a triacetate film base as described below to obtain a color reversal photographic material Sample E-1.

First Layer: Antihalation Layer:

Gelatin layer containing black colloidal silver.

Second Layer: Gelatin Intermediate Layer:

2,5-Di-t-octylhydroquinone (100 g) was dissolved in 100 ml of dibutyl phthalate and 100 ml of ethyl acetate, and the resulting solution was emulsified together with 10% gelatin aqueous solution (1 kg) under high speed stirring to obtain an emulsion. 2 kg of said emulsion was blended with 10% gelatin (1.5 kg) together with 1 kg of a fine particle emulsion (particle size: 0.06 μm, 1 mol% silver bromoiodide emulsion) which was not chemically sensitized, and the resulting mixture was coated to form a coating layer (dry film thickness: 2 μm). Coated silver amount: 0.4 g/m$^2$.

Third Layer: Red-Sensitive Emulsion Layer of Low Sensitivity:

100 g of a cyan coupler of 2-(heptafluorobutyramido)-5-[2'-(2'',4''-di-t-aminophenoxy)-butyramido]phenol was dissolved in 100 ml of tricresyl phosphate and 100 ml of ethyl acetate, and the resulting solution was emulsified with 10% gelatin aqueous solution (1 kg) under high speed stirring to obtain an emulsion. 500 g of said emulsion was blended with 1 kg of a red-sensitive silver bromoiodide emulsion (containing 70 g of silver and 60 g of gelatin, and iodide content of 6 mol%), and the resulting mixture was coated to form a coating layer having a dry film thickness of 1 μm. Coated silver amount: 0.5 g/m$^2$.

Fourth Layer: Red-Sensitive Emulsion Layer of High Sensitivity:

100 g of a cyan coupler of 2-(heptafluorobutyramido)-5-[2'-(2'',4''-di-t-aminophenoxy)-butyramido]phenol was dissolved in 100 ml of tricresyl phosphate and 100 ml of ethyl acetate, and the resulting solution was emulsified with 10% gelatin aqueous solution (1 kg) under high speed stirring to obtain an emulsion. 1,000 g of said emulsion was blended with 1 kg of a red-sensitive silver bromoiodide emulsion (containing 70 g of silver and 60 g of gelatin, and iodide content of 6 mol%), and the resulting mixture was coated to form a coating layer having a dry film thickness of 2.5 μm. Coated silver amount: 0.8 g/m$^2$.

Fifth Layer: Intermediate Layer:

2,5-Di-t-octylhydroquinone (100 g) was dissolved in 100 ml of dibutyl phthalate and 100 ml of ethyl acetate, and the resulting solution was emulsified with 10% gelatin aqueous solution (1 kg) under high speed stirring to obtain an emulsion. 1 kg of said emulsion was blended with 10% gelatin (1 kg), and the resulting mixture was coated to form a coating layer having a dry film thickness of 1 μm.

Sixth Layer: Green-Sensitive Emulsion Layer of Low Sensitivity:

In the same manner as the above first layer with the exception that a magenta coupler of 1-(2,4,6-trichlorophenyl)-3-[3-(2,4-di-t-amylphenoxyacetamido)benzamido]-5-pyrazolone was used instead of the cyan coupler in the first layer, an emulsion was obtained. 300 g of said emulsion was blended with 1 kg of a green-sensitive silver bromoiodide emulsion (containing 70 g of silver and 60 g of gelatin, and iodide content of 7 mol%), and the resulting mixture was coated to form a coating layer having a dry film thickness of 1.3 μm. Coated silver amount: 1.1 g/m$^2$.

Seventh Layer: Green-Sensitive Emulsion Layer of High Sensitivity:

In the same manner as the above first layer with the exception that a magenta coupler of 1-(2,4,6-trichlorophenyl)-3-[3-(2,4-di-t-amylphenoxyacetamido)benzamido]-5-pyrazolone was used instead of the cyan coupler in the first layer, an emulsion was obtained. 1,000 g of said emulsion was blended with 1 kg of a green-sensitive silver bromoiodide emulsion (containing 70 g of silver and 60 g of gelatin, and iodide content of 6 mol%), and the resulting mixture was coated to form a coating layer having a dry film thickness of 3.5 μm. Coated silver amount: 1.1 g/m².

Eighth Layer: Yellow Filter Layer

An emulsion containing a yellow colloidal silver was coated to form a coating layer having a dry film thickness of 1 μm.

Ninth Layer: Blue-Sensitive Emulsion Layer of Low Sensitivity:

In the same manner as the above first layer with the exception that a yellow coupler of α-(pivaloyl)-α-(1-benzyl-5-ethoxy-3-hydantoinyl)-2-chloro-5-dodecyloxycarbonylacetanilide was used instead of the cyan coupler in the first layer, an emulsion was obtained. 1,000 g of said emulsion was blended with 1 kg of a blue-sensitive silver bromoiodide emulsion (containing 70 g of silver and 60 g of gelatin, and iodide content of 7 mol%), and the resulting mixture was coated to form a coating layer having a dry film thickness of 1.5 μm. Coated silver amount: 0.4 g/m².

Tenth Layer: Blue-Sensitive Emulsion Layer of High Sensitivity:

In the same manner as the above first layer with the exception that a yellow coupler of α-(pivaloyl)-α-(1-benzyl-5-ethoxy-3-hydantoinyl)-2-chloro-5-dodecyloxycarbonylacetanilide was used instead of the cyan coupler in the first layer, an emulsion was obtained. 1,000 g of said emulsion was blended with 1 kg of a blue-sensitive silver bromoiodide emulsion (containing 70 g of silver and 60 g of gelatin, and iodide content of 6 mol%), and the resulting mixture was coated to form a coating layer having a dry film thickness of 3 μm. Coated silver amount: 0.8 g/m².

Eleventh Layer: Second Protective Layer:

1 kg of the emulsion used in the above third layer was blended with 1 kg of 10% gelatin, and the resulting mixture was coated to form a coating layer having a dry film thickness of 2 μm.

Twelfth Layer: First Protective Layer:

10% gelatin aqueous solution containing a surface fogged fine particle emulsion (particle size: 0.06 μm, 1 mol% silver bromoiodide emulsion) was coated to form a coating layer having a dry film thickness of 0.8 μm. Coated silver amount: 0.1 g/m².

Another Sample E-2 was prepared in the same manner as Sample E-1 with the exception of the following points: The coupler solvent in the third layer of Sample E-1 was substituted by 2,4-di-t-amylphenol (Compound I-6, as listed hereinbefore), and the coupler solvent in the seventh layer of Sample E-1 was substituted by 2,4-di-t-nonylphenol (Compound I-8, as listed hereinbefore). The sensitivity and the gradation of Sample E-2 were adjusted to the same as those of Sample E-1.

Each of these Samples E-1 and E-2 were subjected to blue exposure and green exposure and to blue exposure and red exposure, respectively, and thereafter subjected to the following reversal development:

In the light exposure, the magenta density and the cyan density were measured by the use of a densitometer of Fuji FSD-103, and the amount of the light for the exposure was so adjusted that said density was 0.5, 1.0, 2.0 and 3.0, respectively.

| Process | Time (min) | Temperature (°C.) |
|---|---|---|
| Standard Processing: | | |

-continued

| Process | Time (min) | Temperature (°C.) |
|---|---|---|
| First Development | 6 | 38 |
| Water Washing | 2 | " |
| Reversing | 2 | " |
| Color Development | 6 | " |
| Compensation | 2 | " |
| Bleaching | 6 | " |
| Fixing | 4 | " |
| Water Washing | 4 | " |
| Stabilization | 1 | Normal Temperature |
| Drying | | |
| Sensitization Processing: | | |
| First Development | 10 | 38 |
| Water Washing | 2 | " |
| Reversing | 2 | " |
| Color Development | 6 | " |
| Compensation | 2 | " |
| Bleaching | 6 | " |
| Fixing | 4 | " |
| Water Washing | 4 | " |
| Stabilization | 1 | Normal Temperature |
| Drying | | |

Solutions used in the above processes were as follows:

| | |
|---|---|
| First Developer: | |
| Water | 700 ml |
| Sodium Tetrapolyphosphate | 2 g |
| Sodium Sulfite | 20 g |
| Hydroquinone.Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml (pH 10.1) |
| Reversing Solution: | |
| Water | 700 ml |
| Hexasodium Nitrilo-N,N,N-trimethylene-phosphonate | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| Color Developer: | |
| Water | 700 ml |
| Sodium Tetrapolyphosphate | 2 g |
| Sodium Sulfite | 7 g |
| Sodium Tertiary Phosphate (12 hydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N-Ethyl-N-(β-methanesulfonamidoethyl)-3-methyl-4-aminoaniline Sulfate | 11 g |
| Ethylenediamine | 3 g |
| Water to make | 1,000 ml |
| Compensating Solution: | |
| Water | 700 ml |
| Sodium Sulfite | 12 g |
| Sodium Ethylenediaminetetraacetate (dihydrate) | 8 g |
| Thioglycerin | 0.4 ml |
| Glacial Acetic Acid | 3 ml |
| Water to make | 1,000 ml |
| Bleaching Solution: | |
| Water | 800 ml |
| Sodium Ethylenediaminetetraacetate (dihydrate) | 2.0 g |
| Ammonium Ethylenediaminetetraacetato Ferrate Dihydrate | 120.0 g |
| Potassium Bromide | 100.0 g |
| Water to make | 1,000 ml |

-continued

| | |
|---|---|
| Fixing Solution: | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilizer Solution: | |
| Water | 800 ml |
| Formalin (37 wt %) | 5.0 ml |
| Fuji Driwel (surfactant by Fuji Photo Film, Co., Ltd.) | 5.0 ml |
| Water to make | 1,000 ml |

After the above processing, the spectral reflection spectrum of each sample was measured with a spectrophotometer, and the maximum absorption wavelength of cyan color image and magenta color image was obtained therefrom. The results are given in the following Table 5.

TABLE 5

| | Maximum Absorption Wavelength (nm) of Color | | | | | | | |
|---|---|---|---|---|---|---|---|---|
| | Magenta Density | | | | Cyan Density | | | |
| Sample No. | 0.5 | 1.0 | 2.0 | 3.0 | 0.5 | 1.0 | 2.0 | 3.0 |
| E-1 (Comparison) | 550 | 550 | 550 | 550 | 662 | 662 | 662 | 662 |
| E-2 (Invention) | 550 | 550 | 553 | 555 | 667 | 664 | 662 | 662 |

Table 5 proves that the maximum absorption wavelength of the cyan image shifted to the side of a short wavelength range and that of the magenta image shifted to the side of a long wavelength range with the increment of the color density in the present sample, and thus, the necessary wavelength shifting could be attained for the enlargement of the color reproducible range to form a color image in the present sample.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material for negative development comprising a support having thereon at least three silver halide emulsion layer units each having a sensitivity to each of three primary colors of blue, green and red, wherein at least one unit among said silver halide emulsion layer units comprises a blue sensitive or green sensitive layer group containing at least two layers each having a different sensitivity and at least the lowest sensitive layer in said layer group contains at least one compound of the general formula (I):

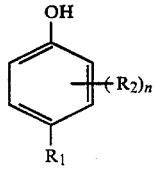

(I)

wherein $R_1$ is a linear, branched or cyclic alkyl group having 1 to 20 carbon atoms, a linear, branched or cyclic alkoxy group having 1 I to 20 carbon atoms, or such a linear, branched or cyclic alkyl group or linear, branched or cyclic alkoxy group substituted with a chlorine atom, a hydroxy group, an alkoxycarbonyl group, an acyl group, or an acylamino group; $R_2$ is a hydrogen atom, a halogen atom or a substituent as defined in said $R_1$; n is an integer of 1 to 4, and when n is 2 or more, said $R_2$'s may be the same or different substituents; with the proviso that the total carbon number in said $R_1$ and $R_2$ is 50 or less; dispersed in said layer together with a coupler, wherein the relation of the color maximum absorption wavelength $\lambda_{max}(LD_{max})$ shown by the layer which is the lowest sensitive layer in said layer group to at least one coloring maximum absorption wavelength $\lambda_{max}(L_x)$ shown by a layer in said layer group having the same color sensitivity as that of the lowest sensitive layer, but which is a layer other than said lowest sensitive layer satisfies the following condition (C)

$$\lambda_{max}(LD_{max})-\lambda_{max}(L_x)\geqq 5 \text{ nm} \quad (C).$$

2. The silver halide color photographic material as claimed in claim 1, wherein the compound of the formula (I) is selected from those of the general formula (II):

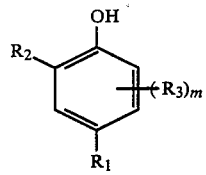

(II)

wherein $R_1$ and $R_2$ have the same meanings as in the formula (I); $R_3$ has the same meaning as $R_2$ in the formula (I); m is an integer of 1 to 3; when the number of $R_3$ is 2 or more, said $R_3$'s may be the same or different substituents or may be the same as $R_2$; with the proviso that the total carbon number in said substituents of $R_1$, $R_2$ and $R_3$ is to be 50 or less.

3. The silver halide color photographic material as claimed in claim 2, wherein $R_2$ is a hydrogen atom, an alkyl group or a halogen atom.

4. The silver halide color photographic material as claimed in claim 2, wherein the total carbon number in said substituents of $R_1$, $R_2$ and $R_3$ is to be 32 or less.

5. The silver halide color photographic material as claimed in claim 1, wherein the compound of the formula (I) is selected from Compounds I-1 through I-21 as follows:

I-1

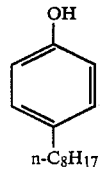

I-2

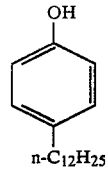

-continued
I-3
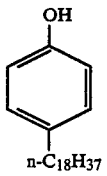
I-4
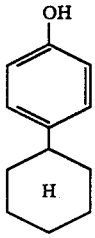
I-5
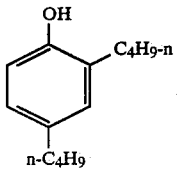
I-6
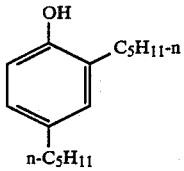
I-7
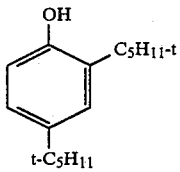
I-8
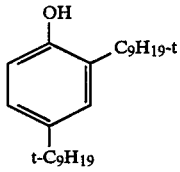
I-9
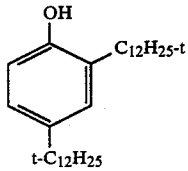
I-10
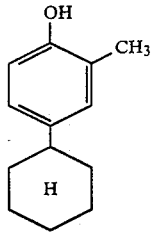
-continued
I-11
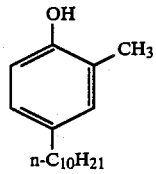
I-12
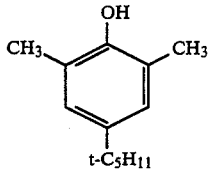
I-13
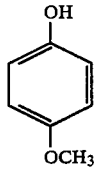
I-14
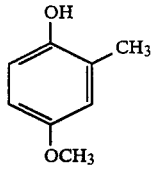
I-15
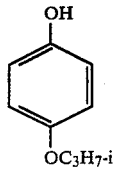
I-16
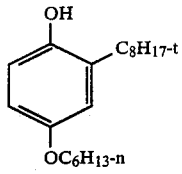
I-17
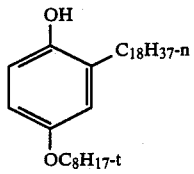
I-18
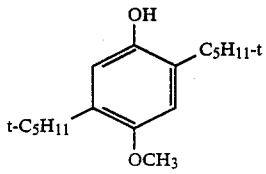
I-19
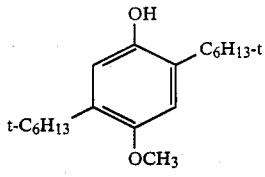

-continued

I-20

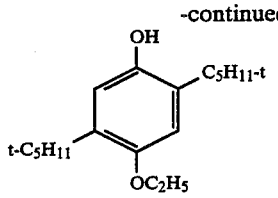

I-21

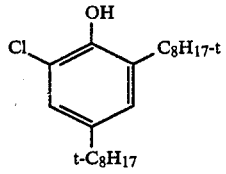

6. The silver halide color photographic material as claimed in claim I, wherein the compound of the formula (I) is incorporated in at least the lowest sensitivity layer in a green-sensitive layer group.

7. The silver halide color photographic material as claimed in claim 1, wherein the amount of the compound of the formula (I) to be incorporated in the emulsion is 1 wt % to 5,000 wt % on the basis of the weight of coupler used.

8. The silver halide color photographic material as claimed in claim 7, wherein the amount of the compound of the formula (I) to be incorporated in the emulsion is 10 wt % to 500 wt % on the basis of the weight of coupler used.

9. The silver halide color photographic materials as claimed in claim 1, wherein the compound of the formula (I) is incorporated in at least the lowest sensitivity layer in a blue-sensitive layer group.

10. A silver halide color photographic material for reversal development comprising a support having thereon at least three silver halide emulsion layer units each having a sensitivity to each of three primary colors of blue, green and red, wherein at least one unit among said silver halide emulsion layer units comprises a blue sensitive or green sensitive layer group containing at least two layers each having a different sensitivity and at least the highest sensitivity layer in said layer group contains at least one compound of the general formula (I):

(I)

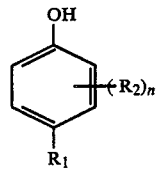

wherein $R_1$ is a linear, branched or cyclic alkyl group having 1 to 20 carbon atoms, a linear, branched or cyclic alkoxy group having 1 to 20 carbon atoms, or such a linear, branched or cyclic alkyl group or linear, branched or cyclic alkoxy group substituted with a chlorine atom, a hydroxy group, an alkoxycarbonyl group, an acyl group, or an acylamino group; $R_2$ is a hydrogen atom, a halogen atom or a substituent as defined in said $R_1$; n is an integer of 1 to 4, and when n is 2 or more, said $R_2$'s may be the same or different substituents; with the proviso that the total carbon number in said $R_1$ and $R_2$ is 50 or less; dispersed in said layer together with a coupler, wherein the relation of the coloring maximum absorption wavelength $\lambda_{max}(LD_{max})$ shown by the layer which is the highest sensitivity layer in said layer group to at least one coloring maximum absorption wavelength $\lambda_{max}(L_x)$ shown by a layer in said layer group having the same color sensitivity as that of the highest sensitive layer, but which is a layer other than said highest sensitive layer satisfies the following condition (C):

$$\lambda_{max}(LD_{max})-\lambda_{max}(L_x)\geqq 5 \text{ nm} \quad (C).$$

11. The silver halide color photographic material as claimed in claim 10, wherein the compound of the formula (I) is selected from those of the general formula (II):

(II)

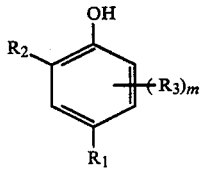

wherein $R_1$ and $R_2$ have the same meanings as in the formula (I); $R_3$ has the same meaning as $R_2$ in the formula (I); m is an integer of 1 to 3; when the number of $R_3$ is 2 or more; said $R_3$'s may be the same or different substituents or may be the same as $R_2$; with the proviso that the total carbon number in said substituents of $R_1$, $R_2$ and $R_3$ is to be 50 or less.

12. The silver halide color photographic material as claimed in claim 11, wherein $R_2$ is a hydrogen atom, an alkyl group or a halogen atom.

13. The silver halide color photographic material as claimed in claim 11, wherein the total carbon number in said substituents of $R_1$, $R_2$ and $R_3$ is to be 32 or less.

14. The silver halide color photographic material as claimed in claim 10, wherein the compound of the formula (I) is selected from compounds I-1 through I-21 as follows:

I-1

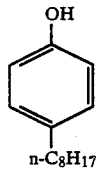

I-2

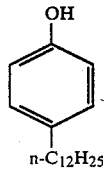

I-3

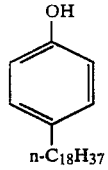

-continued
I-4
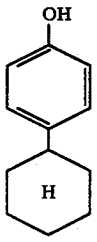
I-5
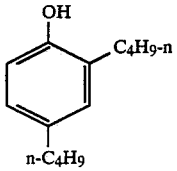
I-6
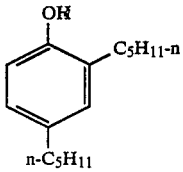
I-7
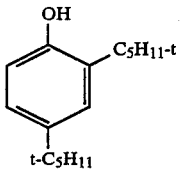
I-8
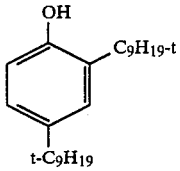
I-9
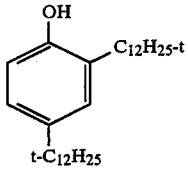
I-10
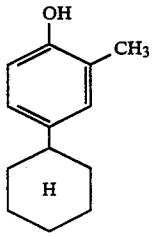
I-11
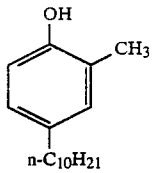
-continued
I-12
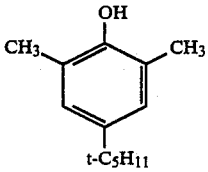
I-13
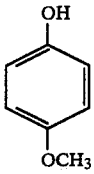
I-14
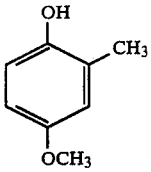
I-15
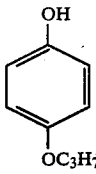
I-16
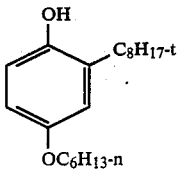
I-17
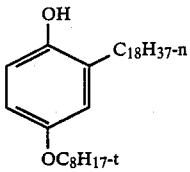
I-18
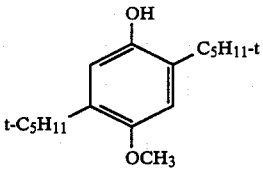
I-19
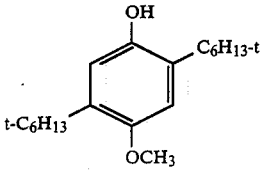
I-20
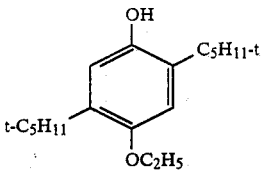

-continued

I-21

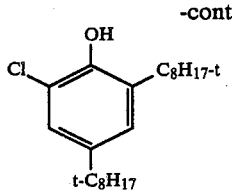

15. The silver halide color photographic material as claimed in claim 10, wherein the compound of the formula (I) is incorporated in at least the highest sensitivity layer in a green-sensitive layer group.

16. The silver halide color photographic material as claimed in claim 10, wherein the amount of the compound of the formula (I) to be incorporated in the emulsion is 1 wt % to 5,000 wt % on the basis of the weight of coupler used.

17. The silver halide color photographic material as claimed claim 16, wherein the amount of the compound of the formula (I) to be incorporated in the emulsion is 10 wt % to 500 wt % on the basis of the weight of coupler used.

18. The silver halide color photographic materials as claimed in claim 10, wherein the compound of the formula (I) is incorporated in at least the highest sensitivity layer in a blue-sensitive layer group.

* * * * *